US006918545B2

(12) United States Patent
Franson et al.

(10) Patent No.: US 6,918,545 B2
(45) Date of Patent: Jul. 19, 2005

(54) SPRINKLER HEAD TRIGGER ASSEMBLY

(75) Inventors: Scott Thomas Franson, Hastings, MI (US); Kenneth Gordor Vos, Lowell, MI (US)

(73) Assignee: The Viking Corporation, Hastings, MI (US)

( * ) Notice: Subject to any disclaimer, the term of this patent is extended or adjusted under 35 U.S.C. 154(b) by 0 days.

(21) Appl. No.: 10/143,379

(22) Filed: May 10, 2002

(65) Prior Publication Data

US 2003/0209353 A1 Nov. 13, 2003

(51) Int. Cl.[7] ..... A62C 37/08

(52) U.S. Cl. ..... 239/37; 239/38; 239/39; 239/DIG. 1

(58) Field of Search ..... 169/37, 38, 39, 169/DIG. 3

(56) References Cited

U.S. PATENT DOCUMENTS

| | | | | | |
|---|---|---|---|---|---|
| ,277,478 | A | | 5/1883 | Grinnell | |
| ,323,578 | A | | 8/1885 | Harkness | |
| ,404,897 | A | | 6/1889 | Clapp | |
| ,425,753 | A | | 4/1890 | Clapp | |
| ,431,971 | A | | 7/1890 | Grinnell | |
| ,431,972 | A | | 7/1890 | Grinnell | |
| ,432,404 | A | | 7/1890 | Grinnell | |
| ,439,864 | A | | 11/1890 | Clapp | |
| ,514,161 | A | | 2/1894 | Newton | |
| ,514,162 | A | | 2/1894 | Newton | |
| ,617,097 | A | | 1/1899 | Higgins | |
| ,750,768 | A | | 1/1904 | Hibbard | |
| ,770,753 | A | | 9/1904 | Hunt | |
| ,792,343 | A | | 6/1905 | Newton | |
| 792,343 | A | * | 6/1905 | Newton | 169/39 |
| ,813,061 | A | | 2/1906 | Smith | |
| ,924,760 | A | | 6/1909 | Goldthwait | |
| 1,051,865 | A | | 2/1913 | Daly | |
| 1,117,411 | A | | 11/1914 | Loepsinger | |
| 1,195,593 | A | | 8/1916 | Kersteter | |
| 1,231,439 | A | | 6/1917 | Simonds et al. | |
| 1,240,292 | A | | 9/1917 | Alexander | |
| 1,253,019 | A | | 1/1918 | Fee | |
| 1,290,298 | A | * | 1/1919 | Newton | 169/39 |
| 1,345,217 | A | * | 6/1920 | Newton | 169/39 |
| 1,498,139 | A | | 6/1924 | Williams | |
| 1,584,719 | A | | 5/1926 | Bisson | |
| 1,849,316 | A | * | 3/1932 | Rowley | 169/38 |
| 3,854,534 | A | | 12/1974 | Pak | |
| 4,343,364 | A | * | 8/1982 | Glinecke | 169/38 |
| 5,609,211 | A | * | 3/1997 | Meyer et al. | 169/37 |
| 5,664,630 | A | | 9/1997 | Meyer et al. | |
| 5,829,532 | A | | 11/1998 | Meyer et al. | |

* cited by examiner

*Primary Examiner*—Dinh Q. Nguyen
(74) *Attorney, Agent, or Firm*—Van Dyke, Gardner, Linn & Burkhart, LLP

(57) ABSTRACT

A quick response trigger assembly for an automatic sprinkler head comprises an inherently unstable compression element positioned between the frame of the sprinkler body and sealing assembly. A thermal sensor surrounds the periphery of the compression element and includes at least one heat gathering element positioned a preselected distance from the compression element. The thermal sensor maintains the compression element in compression when the sprinkler head is in the non-activated condition. The presence of a heat gathering member spaced a preselected distance from the compression element increases the surface area through which conduction occurs, and thus, enables the trigger assembly to exhibit sufficient thermal sensitivity necessary to classify the sprinkler head as a quick response. Additionally, the thermal sensor is formed of two or more members which are substantially identical in configuration to thereby decrease manufacturing costs.

56 Claims, 15 Drawing Sheets

Table 23.1

HIGH - TEMPERATURE EXPOSURE TEST CONDITIONS

| Sprinkler temperature rating | | High ambient test temperature | |
|---|---|---|---|
| Degrees F | (Degrees C) | Degrees F | (Degrees C) |
| 135 - 140 | 57 - 60 | 120 | 49 |
| 145 - 170 | 63 - 77 | 125 | 52 |
| 175 - 225 | 79 - 107 | 175 | 79 |
| 250 - 300 | 121 - 149 | 250 | 121 |
| 325 - 375 | 163 - 191 | 300 | 149 |
| 400 - 475 | 204 - 246 | 375 | 191 |
| 500 - 575 | 260 - 302 | 475 | 246 |

Fig. 2

Table 14.1

TEST PRESSURES FOR THE LEAKAGE AND HYDROSTATIC TESTS

| Rated pressure | | Leakage test pressure | | Hydrostatic test preasure | |
|---|---|---|---|---|---|
| psig | (MPa) | psig | (MPa) | psig | (MPa) |
| 175 | (1.2) | 500 | (3.4) | 700 | (4.8) |
| 250 | (1.7) | 500 | (3.4) | 1000 | (6.9) |
| 300 | (2.1) | 600 | (4.1) | 1200 | (8.3) |

Fig. 3

Figure 26.1
IMPACT TEST APPARATUS

Table 4.30.2(a)

RTI AND C-FACTOR COMBINATIONS

| Response category | RTI $(ft \cdot s)^{1/2}$ [$(m \cdot s)^{1/2}$] | C-Factor $(ft/s)^{1/2}$ [$(m/s)^{1/2}$] | Offset angle (degrees) |
|---|---|---|---|
| Standard | 635 [350] | 1.8 [1.0] | 0 |
| | 455 [250] | 3.6 [2.0] | 0 |
| | 1090 [600] | 9.0 [5.0] | 15 |
| Quick | 90 [50] | 1.4 [0.8] | 0 |
| | 55 [30] | 1.8 [1.0] | 0 |
| | 225 [125] | 3.6 [2.0] | 25 |

Fig. 5

Table 4.30.2(b)
TUNNEL CONDITIONS

| Response category | Plunge tunnel Gas temperature °F [°C] | Plunge Tunnel velocity ft/sec [m/s] | Applied Vacuum (mm Hg) |
|---|---|---|---|
| Standard | 262.4 [128] | 3.28 [1.0] | 0.007 |
| | | 8.53 [2.6] | 0.007 |
| | | 11.48 [3.5] | 0.007 |
| | 386.6 [197] | 3.28 [1.0] | 0.010 |
| | | 8.53 [2.6] | 0.010 |
| | | 11.48 [3.5] | 0.010 |
| | 554.0 [290] | 3.28 [1.0] | 0.013 |
| | | 8.53 [2.6] | 0.013 |
| | | 11.48 [3.5] | 0.013 |
| Quick | 262.4 [128] | 3.28 [1.0] | 0.007 |
| | | 8.53 [2.6] | 0.007 |
| | | 11.48 [3.5] | 0.007 |
| | 386.6 [197] | 3.28 [1.0] | 0.010 |
| | | 8.53 [2.6] | 0.010 |
| | | 11.48 [3.5] | 0.010 |

Fig. 6

MODIFIED PLUNGE TUNNEL TEST PLATE (FOR SENSITIVITY TEST - RECESSED, FLUSH AND CONCEALED SPRINKLERS)

SPRINKLER HEAD TRIGGER ASSEMBLY

BACKGROUND OF THE INVENTION

The present invention relates to sprinkler heads used in automatic fire extinguishing systems for buildings and the like, and in particular, relates to a trigger assembly for a quick response automatic sprinkler head.

Sprinkler heads have long been used in automatic fire extinguishing systems in order to controllably disburse a fluid to suppress or extinguish a fire in a designated area. Typically, the fluid utilized in automatic fire extinguishing systems is water, however, systems have also been developed to disburse other fire extinguishing fluids. In one common design, sprinkler heads include a sprinkler body having a central orifice with an inlet connected to a pressurized supply of water or other fire extinguishing fluid, and an outlet through which the fire extinguishing fluid is expelled. A frame extends from the sprinkler body and projects a preselected distance beyond the outlet of the central orifice. The frame carries a deflector designed to alter the water trajectory in an optimum pattern. The sprinkler head may be coupled to a fluid supply line such that the sprinkler head extends in an upward direction towards the ceiling of the structure, in which case it is referred to as an "upright" sprinkler head. Alternatively, sprinkler heads are characterized as "pendent" when the sprinkler head is coupled to a fluid supply line such that the sprinkler head projects towards the floor. Also, a side wall sprinkler head is defined as one which projects substantially orthogonally from a side wall of an enclosure.

In the non-activated state, water flow through the central orifice is prohibited by the presence of a sealing assembly which sealingly engages the outlet. A trigger assembly, positioned between the sealing assembly and the deflector, imparts a force upon the sealing assembly to maintain its sealing position within the orifice outlet. To maintain the sealing assembly within the orifice outlet, a compression screw or other rotatable member is rotatably positioned within a boss formed at the frame's apex. When rotated, the compression screw places a compressive force upon the trigger assembly, which forces the sealing assembly into the orifice outlet.

In one common design, the trigger assembly is composed of a glass bulb filled with a fluid having a known thermal expansion profile. The glass bulb is oriented between the sealing assembly and the frame's apex, and is placed in compression by the compression screw. The glass material employed must be capable of withstanding the substantially axial load placed thereupon by the compression screw. When the glass bulb is exposed to an elevated temperature indicative of a fire, the fluid encased therein will expand, due to an increase in pressure, causing the rupture or fracture of the glass bulb. Once the glass bulb is fractured, the pressurized water residing within the central orifice expels the sealing assembly from the orifice outlet.

In another common design, the trigger assembly includes a pair of lever arms, each of which is in contact with either the compression screw or the sealing assembly. The lever arms are joined by a fusible link normally including a pair of plates joined by a fusible material such as solder. The lever arms are placed in a biased position by the compression screw and are held in place by the presence of the fusible link. In response to a fire, the solder fuses, relaxing the plates of the fusible link, which in turn releases the levers from their biased position, and results in the actuation of the sprinkler head.

In the 1970's, given the advent of new materials and structures frequently utilized in both business and industrial environments, it was recognized by the sprinkler industry that in certain circumstances, standard or normal sprinklers were incapable of adequately controlling fires in areas containing these newer materials and structures. Specifically, it was found that these materials, subsequent to ignition, rapidly spread the conflagration to surrounding areas before the standard sprinkler head could initiate a suppressive water flow. Hence, in many instances, the standard sprinkler trigger assembly failed to have adequate sensitivity necessary to timely activate the sprinkler head and thus, control the fire. Frequently, the trigger assembly lack of thermal sensitivity was attributed to the design utilizing a pair of levers joined by a fusible link.

In response to the inability of standard sprinklers to effectively combat fires having the newer materials which combust and burn at a faster rate, the industry advanced what is commonly known as "quick response sprinkler heads." The purpose of quick response ("QR") sprinkler heads is to provide a greater sensitivity in the trigger assembly so as to reduce the time period between ignition of the fuel package and the activation of the sprinkler head and thereby prevent the fire from spreading to surrounding areas. These quick response sprinklers normally utilize a glass bulb trigger assembly.

In order to provide uniformity in what constitutes a quick response sprinkler head, the National Fire Protection Association (hereinafter referred to a the "NFPA") generates criteria or regulations for the design of fire sprinkler heads, as well as the installation of fire sprinkler systems. The NFPA is comprised of a wide cross-section of companies and organizations having an expertise and interest in fire protection safety. The NFPA regulations or guidelines are based on data gained by over 100 years of experience in the evaluation of sprinkler systems. Compliance with the NFPA guidelines is frequently required by federal and state enforcement agencies, and is accepted by the insurance industry as one of the definitive guidelines concerning sprinkler head design. Consequently, as a commercial reality, failure of a sprinkler head design to operate successfully within the parameters set by the NFPA effectively prohibits the commercial exploitation of the design.

Section 1.4.5.2 of NFPA 13 (1999 Ed.) defines a quick-response (QR) sprinkler as follows:

A type of spray sprinkler that meets the criteria of 1-4.5.1(a)(1) and is listed as a quick response sprinkler for its intended use.

Section 1-4.5.1 of NFPA 13 (1999 Ed.) states as follows:

1-4.5.1 The following are characteristics of a sprinkler that define its ability to control or extinguish a fire.

(a) Thermal sensitivity. A measure of the rapidity with which the thermal element operates as installed in a specific sprinkler or sprinkler assembly. One measure of thermal sensitivity is the response time index (RTI) as measured under standardized test conditions.

1. Sprinklers defined as fast response have a thermal element with an RTI of 50 (meters-seconds)$^{1/2}$ or less.

Thus as is clear from the above sections of NFPA 13 (1999 Ed.), the ability of a sprinkler head to perform successfully as a quick response sprinkler requires that the trigger assembly have a response time index of 50 (meters-second)$^{1/2}$ or less. The lower the RTI value of a particular sprinkler head, all other variables being equal, the faster the actuation time of the sprinkler head. That is, as the RTI value decreases, the time period between ignition of the fuel package and the subsequent actuation of the sprinkler head decreases, which, in consequence, increases the ability of the sprinkler head to control or suppress the fire and prevent the conflagration from spreading to adjacent areas. The entire NFPA 13 (1999 Ed.) is hereby incorporated herein by reference.

Another organization which promulgates regulations and guidelines concerning fire sprinkler systems, and performs approval tests for such systems is Underwriter's Laboratory, Inc. (hereinafter referred to as "UL"). UL standards are an additional body of regulations which are commonly accepted and relied upon by the fire sprinkler industry, insurance companies, and many state and federal enforcement agencies. As with the NFPA, conformance of a sprinkler head design with the guidelines promulgated by UL, is a practical necessity for the commercial viability of a sprinkler head design.

Section 3.3.12 of UL 199, *Automatic Sprinklers for Fire Protection Service* (10th Ed., 1999) defines a QR sprinkler as follows:

A sprinkler that complies with the applicable requirements for such sprinklers in the Sensitivity Test, Section 19, and that is intended to be installed at standard spacings.

Section 19 of UL 199 (10th Ed., 1999) states in pertinent part, the following:

19.1 General.

19.1.1 An automatic sprinkler, other than a dry-type, shall comply with the following requirements:

d) 19.2.1 and 19.5.1 for QR and QR extended coverage sprinklers.

Section 19.2 of UL 199 states as follows:

19.2 Sensitivity-oven heat test 19.2.1 A QR sprinkler shall have the following operating time characteristics when tested in the sensitivity test oven as specified in 19.2.3–19.2.5:

a) Fourteen seconds or less for each sprinkler when subjected to the test in 19.2.3.

b) Mean time equal to or less than a 1.30 multiple of the mean time of the sprinkler tested in accordance with (a) after being subjected to the exposure tests specified in Sections 23, 26, 28, and 35.

Sections 19.2.3 through 19.2.5 of UL 199 state as follows:

Sprinklers of each style are to be tested in the sensitivity test oven in the pendent position with the heat responsive element located at least 1 inch (25.4 mm) away from the inside surfaces of the oven as follows:

a) For sprinkler designs without frame arms and incorporating symmetrical heat responsive elements and symmetrical sprinkler bodies, ten samples are to be orientated in the pendent position.

b) For sprinkler designs with or without frame arms and incorporating unsymmetrical heat responsive elements or unsymmetrical body designs, ten samples are to be orientated in the pendent position with the heat responsive element upstream of the axis of the sprinkler body.

c) For sprinkler designs incorporating frame arms with symmetrical heat responsive elements, ten samples are to be orientated in the pendent position with the frame arms in a plane perpendicular to the direction of air flow.

d) For ceiling style sprinkler designs incorporating removable cups, escutcheons, and removable closure assemblies, ten samples are to be orientated in the pendent position with the closure assemblies removed. For ceiling style sprinkler designs incorporating an integral closure assembly, ten samples are to be orientated in the pendent position with the heat responsive element exposed to the air flow.

19.2.4 The samples are to be conditioned at 75±2° F. (24±1° C.) for at least 2 hours. The inlet end of each sprinkler sample is to be connected to a source of air pressure at 4±1 psig (28±7 kPa) and quickly plunged into the sensitivity test oven in a pendent position. Each sprinkler is to be observed to determine if operation occurs as intended within the time specified in 19.2.1.

19.2.5 The sensitivity test oven is to consist of an 8 inch (203 mm) square stainless steel chamber as shown in FIG. 19.1. A constant air velocity of 8.33±0.05 feet per second (2.54±0.01 m/s) and an air temperature as specified in Table 19.1 for each temperature rating and style sprinkler are to be established. Air velocity is to be measured using an orifice plate and a manometer or a bidirectional probe and a velometer. The air temperature is to be measured by use of a No. 30 AWG (0.05 $mm^2$) thermocouple centered upstream from the sprinkler as shown in FIG. 19.1.

FIG. 19.1, referenced in Section 19.2.5 of UL 199 is reproduced herein as FIG. 1.

Section 23 of UL 199 reads as follows:

23 High Temperature—Test for Uncoated Sprinklers 23.1 An uncoated automatic sprinkler shall withstand for 90 days, without evidence of weakness or malfunction, an exposure to a high-ambient temperature in accordance with Table 23.1, or 20° F. (11° C.) below the rated operating temperature of the samples (whichever is the lower temperature), and not less than 120° F. (49° C.). Following the exposure, each sprinkler shall comply with the Leakage Test, Section 14. Sprinklers of other than the dry type and QR recessed, QR concealed, QR-EC recessed, and QR-EC concealed are to then be subjected to the Sensitivity—Oven Heat Test, see 19.2.1–19.2.5. The Sensitivity—Room Heat Test is to be conducted on QR recessed, QR concealed, QR-EC recessed and QR-EC concealed type sprinklers, see 19.5.1–19.5.5; and the Response Test for Ordinary and Intermediate Temperature Rated Ceiling Type Sprinklers is to be conducted on standard response type recessed and concealed sprinklers, see 19.3.1–19.3.5. Each sample shall be operable, and the average time of operation shall not increase more than a 1.3 multiple when compared to the average time of samples not subjected to the High Temperature—Test for Uncoated Sprinklers. Dry-type sprinklers are to then be subjected to the plunge test described in 35.3.

Table 23.1, referenced in Section 23.1 of UL 199 is set forth herein as FIG. 2.

Section 19.5.1–19.5.5, referenced in Section 23.1, is as follows:

19.5.1 Ordinary or intermediate temperature rated QR sprinklers and QR extended coverage sprinklers for light hazard occupancies shall have an operating time of 75 seconds or less for each sprinkler when tested as specified in 19.5.3–19.5.5. Ordinary or intermediate temperature rated QR extended coverage sprinklers for ordinary hazard occupancies shall have an operating time of 55 seconds or less for each sprinkler when tested as specified in 19.5.3–19.5.5.

19.5.2 A recessed or concealed sprinkler having a vented escutcheon is to be installed and tested in an unblocked manner, that is, in a manner that does not inhibit air flow through the escutcheon.

19.5.3 Sprinklers of each type are to be installed in a test room (see 19.5.4) in the following position and orientation:

a) For pendent and ceiling type sprinkler designs without frame arms and incorporating symmetrical heat responsive elements and symmetrical sprinkler bodies, ten samples are to be installed in their intended position at the ceiling.

b) For pendent and ceiling type sprinkler designs with or without frame arms and incorporating unsymmetrical heat responsive elements, ten samples are to be orientated with the heat responsive element downstream of the axis of the sprinkler body in relation to the direction of the fire source. The samples are to be in their intended position.

c) For pendent and ceiling type sprinkler designs incorporating frame arms with symmetrical heat responsive elements, ten samples are to be orientated with the frame arms in a plane parallel to the direction of the fire source. The samples are to be installed in their intended position.

d) For upright sprinklers having configurations referenced in (a), (b), and (c), ten samples are to be installed in the pendent position.

e) For sidewall sprinkler designs, ten samples are to be installed in their intended position with the deflector located 4 inches (102 mm) below the ceiling.

19.5.4 The sprinkler is to be mounted as specified in 19.5.3 on a ceiling or a wall of a closed room having an 8 foot (2.4 m) high ceiling. For a QR sprinkler, the room is to be 15 by 15 feet (4.6 by 4.6 m). For a QR extended coverage sprinkler, the room size is to be as specified by the manufacturer and be the same dimensions used for the extended coverage tests in these requirements. The sprinkler inlet waterway is to be filled with water having a temperature of 70±3° F.(21±1.6° C.). The water is to be pressurized to 4½±½ psig (31±3.4 kPa), when required for sprinkler operation.

19.5.5 The fire source is to consist of a 1 by 1 by 1 foot (305 by 305 by 305 mm) sand burner located in one corner of the room with a flow of natural gas of 500 standard cubic feet (14.2 $m^3$) per hour for ordinary temperature rated sprinklers and 600 standard cubic feet (17.0 $m^3$) per hour for intermediate temperature rated sprinklers. A pendent, upright, or ceiling type sprinkler is to be installed along a diagonal line on the ceiling at a distance of 16 feet, 9 inches (5.1 m) from the corner of the room where the sand burner is located. A pendent, upright, or ceiling type extended coverage sprinkler is to be installed in the intended position at a point where a diagonal line from the corner having the burner to the opposite corner intersects an arc having a radius equal to the distance from the corner having the burner to the midpoint of the opposite wall. A sidewall sprinkler is to be installed on the midpoint of the furthest wall furthest the corner having the sand burner. The test is to be started when the ambient temperature is 87±2° F. (31±1° C.) for ordinary temperature rated sprinklers and 120±2° F. (49±1.1° C.) for intermediate temperature rated sprinklers, as measured in the center of the room 10 inches (254 mm) below the ceiling. The gas burner is to be ignited, and the operation time of the sprinkler is to be recorded.

The leakage test of Section 14 of UL 199, referenced in Section 23 is as follows:

14 Leakage Test 14.1 When tested as described in 14.2 and 14.3, an automatic sprinkler shall not exhibit leakage at any pressure from 0 to the applicable leakage test pressure shown in Table 14.1.

14.2 At least 20 samples are to be individually tested. The sprinkler inlets are to be filled with water and vented of air.

14.3 The pressure is to be increased from 0 to the test pressure at a rate not exceeding 300 psig (2.07 MPa) per minute and then held for 1 minute. There shall be no visible leakage in any sample.

Table 14.1, referenced in Section 14.1 is reproduced herein as FIG. 4.

Section 26, entitled Impact Resistance Test states as follows:

26 Impact Resistance Test 26.1 An automatic sprinkler shall not be damaged or leak when tested as described in 26.2. See FIG. 26.1.

26.2 Five sample ½-inch nominal orifice sprinklers are to be tested by dropping a cylindrical mass equivalent to the mass of the sprinkler to the nearest 15-g increment from a height of one meter onto the geometric center of the deflector or, when this is not practicable, onto the butt end of the sprinkler. The mass is to be prevented from impacting more than once upon each sample. Following the impact, each sprinkler is to be visually examined and there shall be no evidence of cracks, breaks, or any other damage. Each sample sprinkler shall then withstand a 435 psig (3 MPa) hydrostatic pressure for 1 minute without leakage. In addition, each sample shall then be subjected to the Sensitivity—Oven Heat Test, see 19.2.1–19.2.5, and shall operate at within a 1.3 multiple of the mean time obtained on samples not subjected to the Impact Resistance Test.

FIG. 26.1, referenced in § 26.1 is reproduced herein as FIG. 5.

Section 28 of UL 199 is as follows:

28 Vibration Test 28.1 An automatic sprinkler shall withstand the effects of vibration without deterioration of its performance characteristics. The sprinkler is to be subjected to vibration of 0.04 inch (1.0 mm) amplitude for 120 hours at a frequency that is continuously varied between 18 and 37 hertz. However, when the sprinklers exhibit a resonance at a frequency within the range of 18 to 37 hertz, the resonant frequency is to be used for the entire test period. Following the vibration test, the sprinkler shall comply with the Leakage Test, Section 14. In addition, the sprinkler shall operate as intended when subjected to the Sensitivity—Oven Heat Test, see 19.2.1–19.2.5.

28.2 Five sprinkler samples are to be threaded into the pipe couplings on a steel mounting plate, and the plate is to be bolted to the table of a vibration machine so that the sprinklers are mounted vertically. When dry sprinklers are tested, they are to be samples of the maximum length. The test sprinklers then are to be vibrated in the vertical direction.

28.3 This test is to be conducted with the test sprinklers unpressurized.

28.4 For these tests, amplitude is defined as the maximum displacement of sinusoidal motion from position of rest to one-half of the total table displacement; resonance is defined as the maximum magnification of the applied vibration.

Section 35 is as follows:

35 10-Day Corrosion Test 35.1 The external parts of an automatic sprinkler shall withstand an exposure to salt spray, hydrogen sulfide, and carbon dioxide-sulfur dioxide atmospheres when tested in accordance with 36.1.4–36.5.1 for ten days each. Following the exposure:

a) The Sensitivity—Oven Heat Test is to be conducted on sprinklers other than QR recessed, QR concealed, QR-EC recessed and QR-EC concealed types, see 19.2.1–19.2.5;

b) The Sensitivity—Room Heat Test is to be conducted on QR recessed, QR concealed, QR-EC recessed and QR-EC concealed type sprinklers, see 19.3.1–19.3.5; and c) The Response Test for Ordinary and Intermediate Temperature Rated Ceiling Type Sprinklers is to be conducted on standard response type ceiling sprinklers, see 19.3.1–19.3.5.

Each sample shall be operable, and the average time of operation shall not increase more than a 1.3 multiple when compared with the average time of operation of samples not subjected to the 10-Day Corrosion Test. During the corrosive exposure, the inlet thread orifice is to be sealed by a plastic cap after the sprinkler has been filled with de-ionized water.

35.2 A dry pendent or dry ceiling sprinkler that uses an operating assembly of the same type that has complied with the operation requirements specified in 35.1 shall be subjected to the plunge test specified in 35.3. After the heat-responsive element operates, all parts shall clear the waterway under an air pressure of 10 psig (69 kPa).

35.3 The plunge test is to be conducted in a full draft air oven that has been preheated to a temperature of 300±5° F. (149±3° C.) or a temperature of 100° F. (55.6° C.) higher than the marked temperature rating, whichever is higher. Each sprinkler is to be individually connected to a 10 psig (69 kPa) air supply and quickly placed in the oven in the pendent position.

Sections 36.1.4 through 36.5.1 referenced in Section 35.1 is as follows:

36.1.4 Three groups, each consisting of five sample sprinklers, are to be assembled. One group is to be exposed to 20 percent salt spray, the second to hydrogen sulfide, and the third to sulfur dioxide-carbon dioxide.

36.1.5 CAUTION—Hydrogen sulfide and sulfur dioxide are both toxic gasses. Hydrogen sulfide gas is also flammable. Because of this, such gasses must be stored, transferred, and used only with gastight systems. Adequate ventilation must also be provided to handle any accidental leakage. Presence of these gases is readily noticeable. Due to their unpleasant order and irritant effect, they give warning of their presence.

The entire UL 199 (10th Ed., 1999) is hereby incorporated herein by reference.

Still another organization recognized by the sprinkler industry, and various insurance and government bodies as providing definitive guidelines for the design of automatic sprinklers is the Factory Mutual Research Corporation ("FMRC"). FMRC's *Approval Standard for Automatic Sprinklers for Fire Protection*, Class Series 2000, May 1998, Section 1.9 defines a QR sprinkler as follows:

A sprinkler having an RTI equal to or less than 90 $(ft\cdot s)^{1/2}[50(m\cdot s)^{1/2}]$, and a C-factor equal to or less than 1.8 $(ft/s)^{1/2}[1.0\ (m/s)^{1/2}]$. For recessed, flush and concealed sprinklers the criteria outlined in Sections 4.30 or 4.31 must be met, as appropriate.

A C-factor is defined as:

A measure of the conductance between the sprinkler's heat responsive element and the other components of the sprinkler expressed in units of $(ft/s)^{1/2}$ or $(m/s)^{1/2}$.

Section 4.30, referenced in the definition of a quick response sprinkler is as follows:

4.3 Sensitivity (Recessed, Flush, and Concealed Types)

4.30.1 Requirements

Both standard and quick response recessed, flush and concealed automatic sprinklers shall operate within the maximum response times as calculated in Section 4.30.2(A) when tested as detailed in Section 4.30.2(B), in the least protrusive position as possible. Recessed, flush, and concealed extended coverage light hazard sprinklers shall comply with the requirements of Section 4.31. All of the test points must pass the stated criteria.

4.30.2 Test/Verification

A. The maximum response time shall be calculated using the combination of RTI and C-factor shown in Table 4.30.2(a) and the plunge tunnel conditions detailed in Table 4.30.2(b) for the respective response category.

The maximum permitted sprinkler operating times can be calculated using the following equation:

$$t_{max} = \frac{(-RTI)(1n[1 - 1 - \Delta T_b(1 + C/(u)^{1/2})/\Delta T_g])}{(u)^{1/2}(1 + C/u^{1/2})}$$

where:

$t$max=Maximum Allowed Response time of sprinkler, seconds

RTI=Response Time Index from Table 4.30.2(a), $(ft\cdot s)^{1/2}$ $[(m\cdot s)^{1/2}]$ $\Delta T_b$=Upper temperature limit of the sprinkler (1.035× nominal temperature rating) minus the ambient temperature, ° F. (° C.)

C=Conductivity factor from Table 4.30.2(a), $(ft/s)^{1/2}$ $[(m/s)^{1/2}]$ u=Air velocity in the test section of the tunnel from Table 4.30.2(b), ft/s (m/s)

$\Delta T_g$=Air temperature corrected for radiation effects on a the temperature sensing device, in the test section (see table 4.30-2(b)) minus the ambient temperature, ° F. (° C.)

B. Compliance with the requirements for maximum operating time shall be determined by operating sprinkler samples in the FMRC plunge tunnel, using the modified plunge tunnel test plate described in FIG. E-8.

The sprinklers shall be tested in both the best case orientation and the worst case orientation as if the sprinkler was a pendent sprinkler. For the worst case orientation, the angular offset shall be 15° for standard response sprinklers and 25° for quick response (see Table 4.30.2(a)).

A vacuum in accordance with Table 4.30.2(b) shall be applied to and maintained in the upper enclosure of the modified plunge tunnel test plate (FIG. E-8). The test shall be repeated three times at each condition to ensure accuracy and product repeatability.

Tables 4.30.2(a) and 4.30.2(b) referenced in Section 4.30.2(A) are reproduced herein as FIGS. 6 and 7, respectively. FIG. E-8, referenced in Section 4.30.2(B) is reproduced herein as FIG. 8.

The entire FMRC *Approval Standard for Automatic Sprinklers for Fire Protection*, Class Series 2000, May 1998, is hereby incorporated herein by reference. Foreign countries have similar organizations which provide guidelines and criteria for the design and installation of sprinkler heads such as, for example, BRE Certification Limited in the United Kingdom, and Verband der Sachuersicherer in Germany.

As the foregoing guidelines make clear, a quick response sprinkler head must exhibit an increased thermal sensitivity. In most instances, because of the unacceptable response times of fusible links, the industry has been relegated to using a frangible glass bulb trigger assembly. The glass bulb trigger assembly, in contrast to most lever type trigger assemblies, is capable of exhibiting the sensitivity necessary to identify the sprinkler head in which it is used as a quick response sprinkler head. The manufacturing complexity of encasing a fluid with a known thermal expansion profile within a glass bulb having sufficient strength to withstand a compressive load imparted by the compression screw makes the glass bulb trigger assembly relatively expensive to manufacture. Furthermore, the materials necessary to manufacture the glass bulb trigger assembly also increases the cost of manufacturing.

Consequently, there exists a need within the industry for a trigger assembly capable of withstanding the direct compressive load imparted by the compression screw which is cost effective to manufacture, and exhibits the requisite performance characteristics necessary to be classified as a quick response sprinkler head.

SUMMARY OF THE INVENTION

The present invention overcomes the problems confronted by the sprinkler industry by advancing a cost effective trigger assembly which utilizes no glass or fluid components, which is direct loaded, and includes a minimum number of components to reduce the cost and complexity of manufacturing. Although the trigger assembly of the present invention may be used in conjunction with any sprinkler head, it is particularly suited for use in conjunction with quick response sprinkler heads, as its configuration results in a thermal sensitivity sufficient to classify the sprinkler head as quick response.

According to one aspect of the invention, a trigger assembly for an automatic sprinkler head includes a compression element positioned between a frame and a sealing assembly of the automatic sprinkler head. The trigger assembly also includes a thermally sensitive element surrounding at least in part the compression element and joined at least in part to the compression element by a fusible material. The thermally sensitive element includes at least two portions, each of which includes an attachment section shaped to substantially correspond to at least a section of the compression element, at least one connection section projecting from the attachment section in a direction away from the compression element, and at least one fin projecting from the distal end of the at least one connection section. The fin has a portion thereof defining a plane which forms an angular relationship to at least a portion of the connection section. The thermally sensitive element enhances the magnitude of compression of the compression element when joined thereto, and releases the sealing assembly when the thermally sensitive element is removed from the compression element. The fins of the thermally sensitive element increases the strength of the trigger assembly and the efficient retention and transportation of heat to the fusible material, which in turn increases the thermal sensitivity of the sprinkler head.

According to another aspect of the invention, a trigger assembly for an automatic sprinkler head comprises a compression element positioned between a sealing assembly and a compression member of the sprinkler head which is mounted on a frame of the sprinkler head to adjustably exert compression on the trigger assembly. The compression element extends longitudinally with respect to the frame of the sprinkler head and has a center axis. The compression element is inherently unstable when subjected to a compressive force along its center axis by adjustment of the compression member. The trigger assembly also includes a thermally sensitive element, which has an attachment section surrounding at least a portion of the compression element and is joined at least in part to the compression element by a fusible material. The thermally sensitive element is configured to maintain the compression element in a stable position between the compression member and the sealing assembly when the fusible material is below the fusing temperature and release the compression element to an unstable condition when the fusible material is above the fusing temperature. Additionally, the thermally sensitive element has at least one heat gathering member spaced from the attachment section. The heat gathering member defines at least one plane which is not co-planar with a plane defined by the center axis of the compression element. The combination of a compression element which is inherently unstable unless maintained in position by a thermally sensitive element eliminates the need for the use of a glass bulb trigger assembly. Furthermore, the heat gathering member spaced from the attachment section of the thermally sensitive element increases the heat receptive surface area, and results in a trigger assembly having a faster response time.

According to yet another aspect of the invention, a quick response sprinkler head comprises a sprinkler body having a central orifice defining a fluid outlet. A sealing assembly releasably seals the outlet to prevent fluid flow through the outlet, while a frame extending from the sprinkler body beyond the outlet carries a boss having an aperture dimensioned to receive a compression member. A direct load trigger assembly for releasably retaining the sealing assembly at the outlet includes a compression element, which extends longitudinally with respect to the sprinkler head and has a first end abutting the compression member and a second end abutting the sealing assembly. A thermally sensitive element is attached, at least in part, to the exterior of the compression element by a fusible material and has an attachment section surrounding at least a section of the compression element, at least one heat gathering member extending in a direction away from the compression element, and at least a portion forming a plane angularly related to the longitudinal axis of the compression element. The thermally sensitive element maintains the compression element in compression between the compression member and the sealing assembly when the fusible material is below the fusing temperature. Employing a heat gathering member spaced from the attachment section of a thermally sensitive element exposes the trigger assembly to a greater quantity of heat and thus decreases the response time index of the sprinkler head.

According to still yet another aspect of the invention, a quick response sprinkler head includes a sprinkler body having a central orifice forming an outlet, a frame extending from the sprinkler body and beyond the outlet, and a compression member movably mounted to the frame. An externally activated direct load trigger assembly is disposed between the compression member and the sealing assembly and releasably retains the sealing assembly at the orifice outlet and has a response time index (RTI) of less than, or equal to, approximately 90 $(ft \cdot s)^{1/2}$[50 $(meters—second)^{1/2}$]. Providing an externally activated direct load trigger assembly having a response time index of less than, or equal to, approximately 90 $(ft \cdot s)^{1/2}$[50 $(meters—second)^{1/2}$] greatly reduces the manufacturing costs associated with a quick response sprinkler head by eliminating the reliance on glass bulb trigger assemblies.

According to a further aspect of the invention, a quick response sprinkler head includes a sprinkler body having a central orifice forming an outlet, a frame extending from the sprinkler body beyond the outlet, and a boss, carried by the frame, which includes an aperture into which the compression member is moveably positioned. An externally activated direct load trigger assembly, disposed between the compression member and the sealing assembly, releasably retains a sealing assembly at the orifice. Further, the sprinkler head complies with Sections 19.2.1 and 19.5.1 of UL 199, 10th Ed. 1999.

According to yet another aspect, the quick response sprinkler head has a RTI value equal to or less than approximatey $90(ft\cdot s)^{1/2}[50(m\cdot s)^{1/2}]$ and a C factor equal to or less than $1.8(ft\cdot s)^{1/2}[1.0(m\cdot s)^{1/2}]$, and complies with the criteria outlined in Section 4.30 of *Approval Standard, Automatic Sprinklers for Fire Protection*, Factory Mutual Research Corporation, May 1998. Providing a sprinkler head which satisfies the criteria promulgated by various industry recognized organizations, and employs an externally activated, direct load trigger assembly greatly reduces manufacturing costs, while enabling the sprinkler head to be classified as quick response.

These and other features and advantages of the present invention will be further understood and appreciated by those skilled in the art by reference to the following specification, claims and drawings.

BRIEF DESCRIPTION OF THE DRAWINGS

FIG. 2 is a reproduction of Table 23.1 of UL 199 (10th Ed., 1999);

FIG. 3 is a reproduction of Table 14.1 of UL 199 (10th Ed., 1999);

FIG. 5 is a reproduction of Table 4.30.2(a) of Approval Standard, Automatic Sprinklers for Fire Protection, FMRC, Class Series 2000, May 1998;

FIG. 6 is a reproduction of Table 4.30.2(b) of Approval Standard, Automatic Sprinklers for Fire Protection, FMRC, Class Series 2000, May 1998;

DETAILED DESCRIPTION OF THE PREFERRED EMBODIMENTS

The present invention is a quick response, externally activated direct load trigger assembly for a sprinkler head. The trigger assembly of the present invention is manufactured with a minimum number of components, and by its configuration, reduces the response time index of the sprinkler head to which it is attached. Although the trigger assembly of the present invention is suitable for use with any sprinkler head, it finds particular application in sprinkler heads that must be classified as quick response. The trigger assembly utilizes no glass or expandable fluids, and thus drastically reduces the cost of manufacturing.

Figure 1:
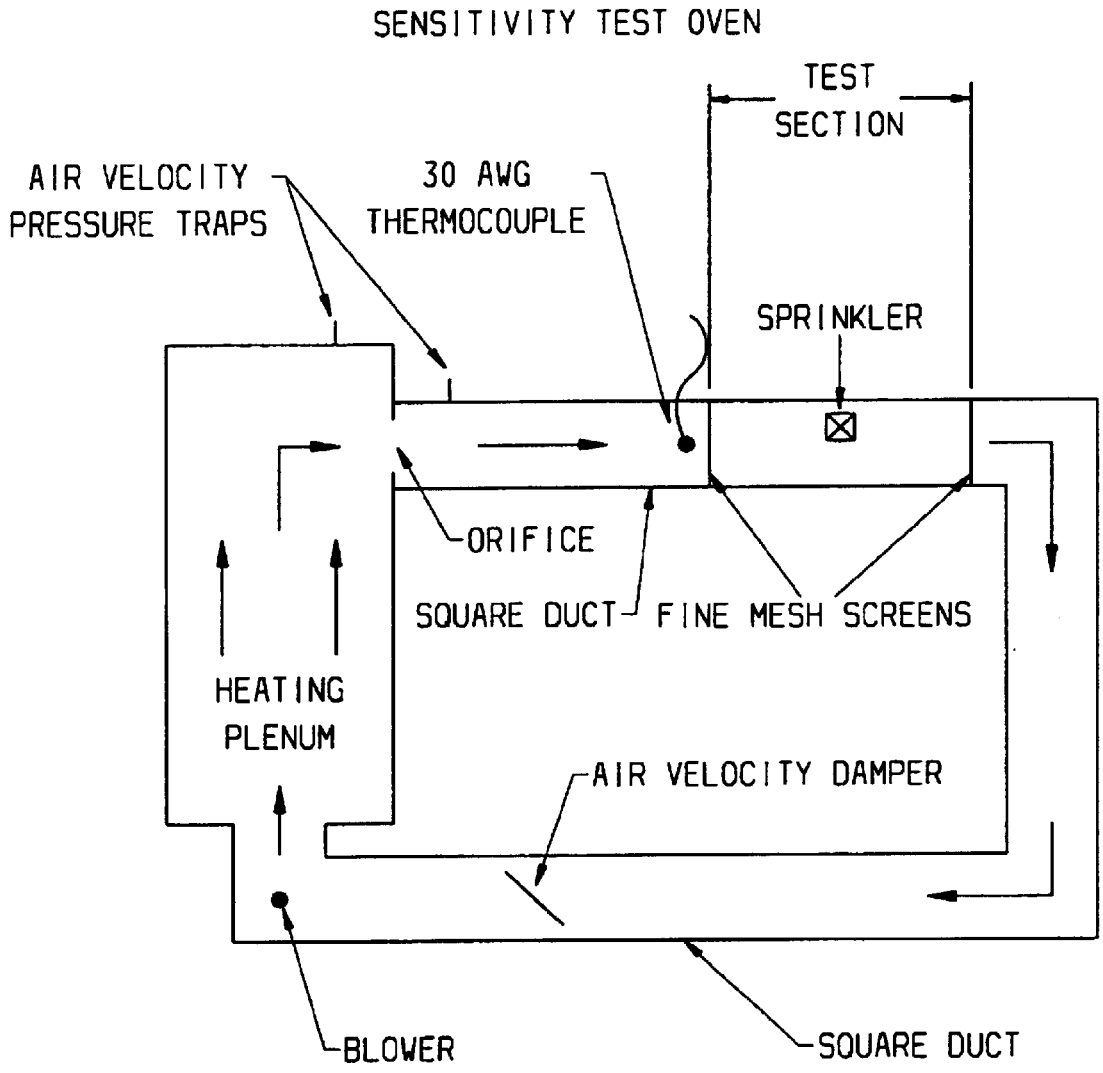
FIG. 1 is a reproduction of FIG. 19.1 of UL 199 (10th Ed., 1999)
Figure 4:
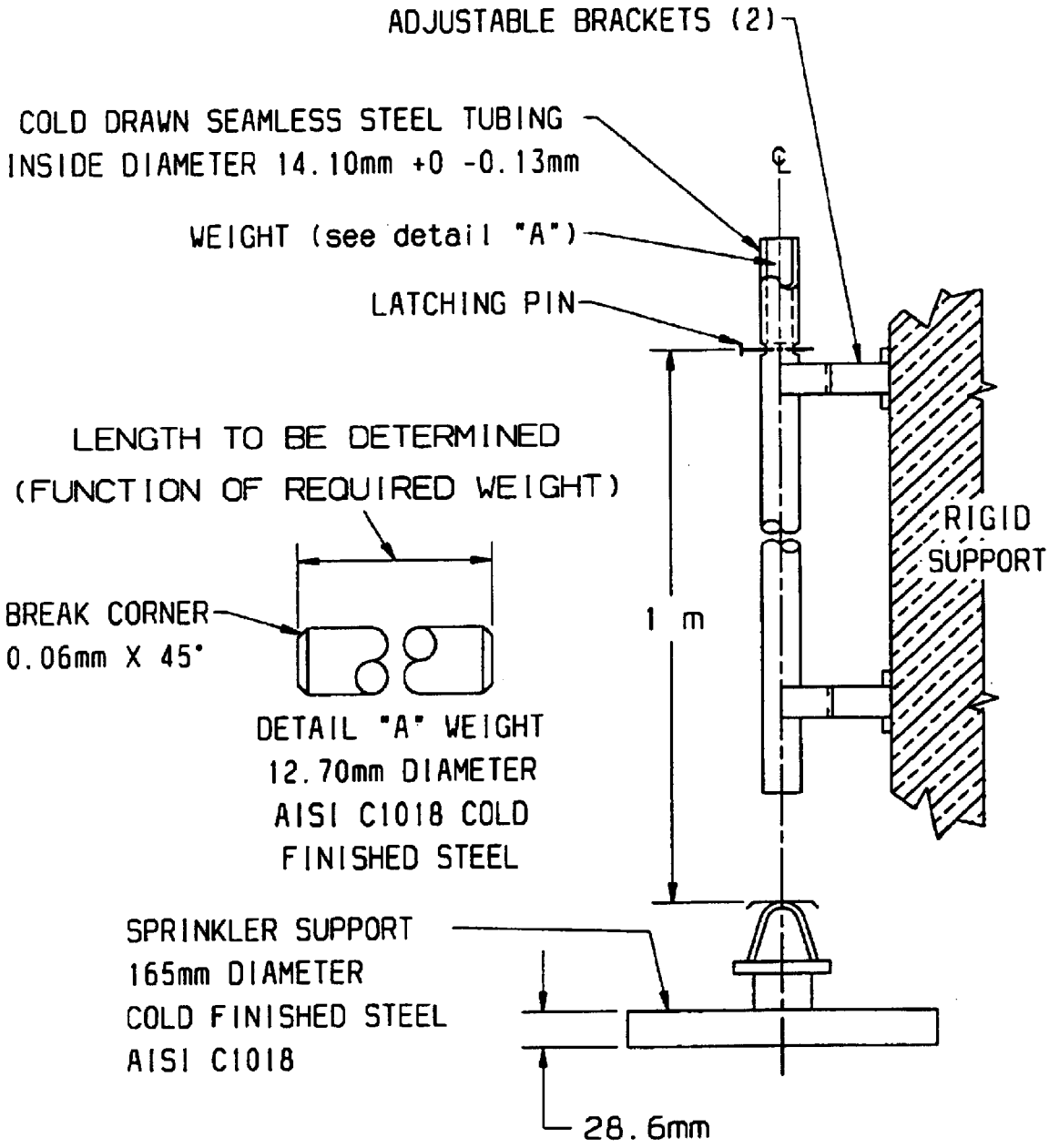
FIG. 4 is a reproduction of FIG. 26.1 of UL 199 (10th Ed., 1999)
Figure 7:
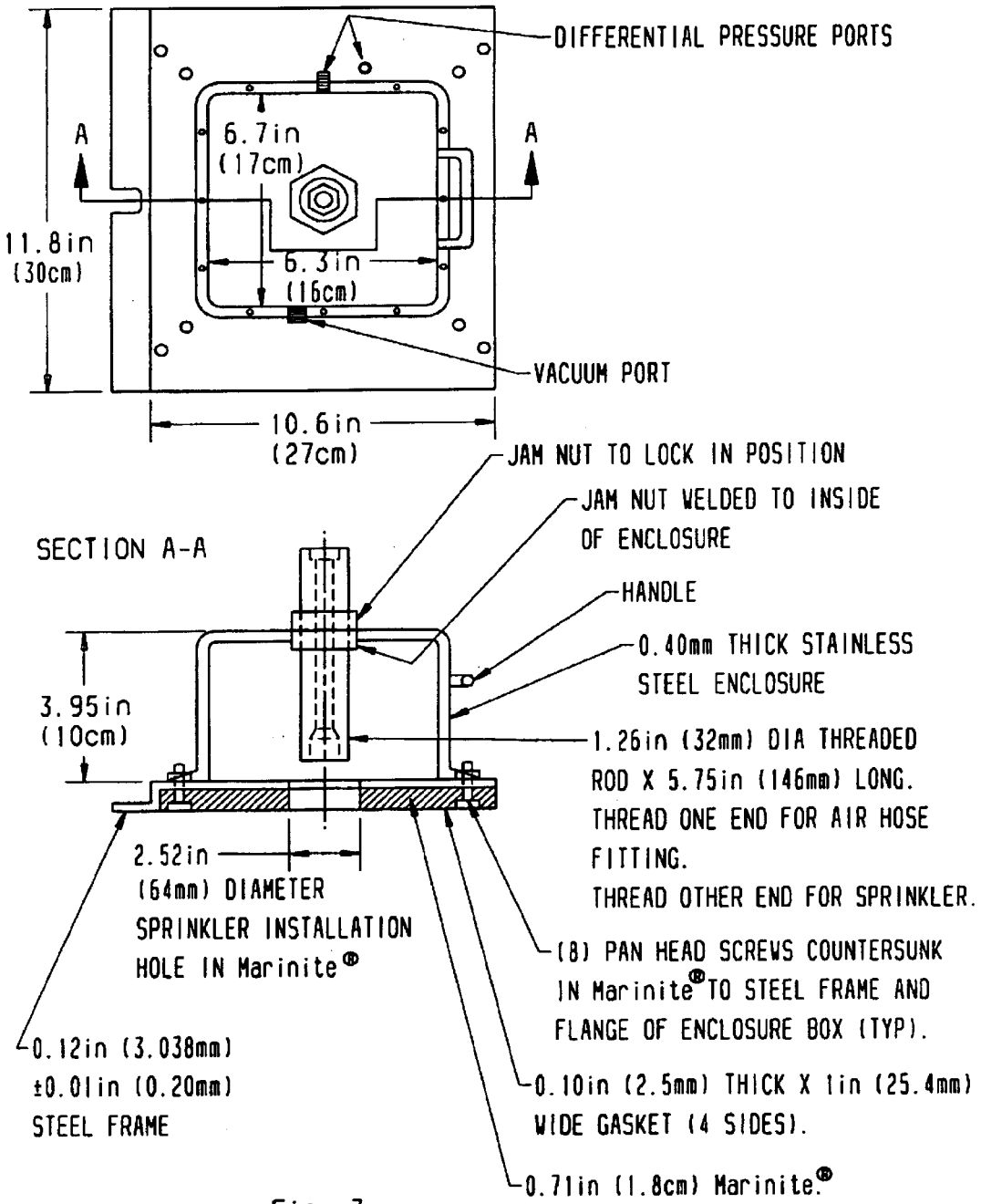
FIG. 7 is a reproduction of FIG. E-8 of Approval Standard, Automatic Sprinklers for Fire Protection, FMRC, Class Series 2000, May 1998.
Figure 8:
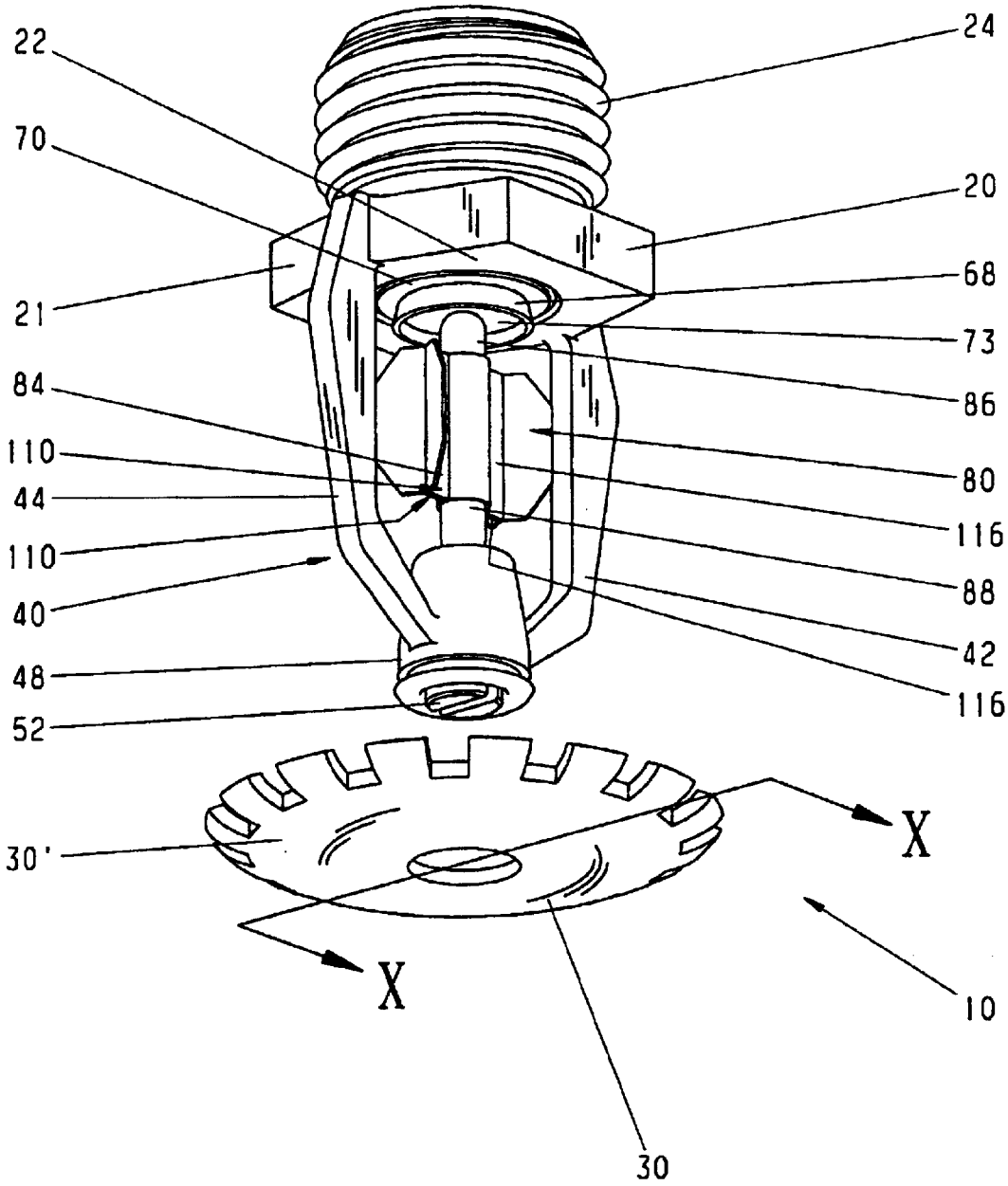
FIG. 8 is a partially exploded, perspective view of a sprinkler head having a trigger assembly according to the present invention.

Referring now to Figures, wherein like reference numerals correspond to like elements in the several drawings, a quick response sprinkler head 10 includes a sprinkler frame or body 20 and a fluid deflector 30 positioned a preselected distance from top region 22 of sprinkler body 20 by a frame 40 (FIG. 8). A quick response, externally activated, direct load trigger assembly 80 is mounted between sprinkler body 20 and deflector 30. As used herein, "externally activated" shall mean that no fluid or thermally expandable material is encased within the trigger assembly such that the thermally responsive fluid causes the shattering or cracking of the material in which it is encased. Sprinkler body 20 includes an externally threaded bottom region 24, permitting sprinkler body 20 to be rotatably attached to a fire extinguishing fluid supply line or pipe. A central orifice 26 is formed in sprinkler body 20. Central orifice 26 provides a fluid flow passageway, enabling the expulsion of fire extinguishing fluid from outlet 27 of central orifice 26 in response to a fire.

Frame 40 is defined by a pair of frame arms 42 and 44, which extend from exterior surface 21 of sprinkler body 20 and project beyond top region 22. Frame arms 42, 44 each have an angled section 45 which meet to define an apex 46. Apex 46 of frame 40 is formed with a central member or boss 48 having formed therethrough an internally threaded bore 49. Bore 49 is dimensioned to threadably receive a compression member or screw 52, which applies a compressive force onto actuator 82, which will be more fully described below. Outlet 27 is formed with a counter bore 28, which defines an annular shoulder 29, which provides a bearing surface for an annular spring 70, also more fully described below.

In the non-activated state, outlet 27 of sprinkler head 10 is sealed by a sealing assembly 65. Sealing assembly 65 includes a plug 68 and an annular spring 70. Plug 68 is formed having an internal section 72, which in the assembled position, projects a preselected distance into central orifice 26 through spring 70. Internal section 72 of plug 68 contains a central channel 74. Plug 68 further includes an external section 75, which extends upwardly beyond top region 22 of sprinkler body 20 and between frame arms 42, 44 of frame 40. Annular spring 70 includes a central aperture 71 dimensioned to enable the passage of internal section 72 of plug 68 to pass therethrough. In the assembled position, annular spring 70 is supported by annular shoulder 29 and provides support for external section 75 of plug 68. When sprinkler head 10 is in the assembled condition, annular spring 70 is placed in compression so that once sprinkler head 10 is activated, the annular spring 70 and plug 68 eject from outlet 27. An insert 73 is positioned within plug 68 and is supported by a shoulder 69, formed at the transition between internal section 72 and external section 75. Insert 73 includes a central detent 76 for receiving actuator 82, described in greater detail in reference to FIGS. 8–12. When sprinkler head 10 is in the assembled condition, annular spring 70 is placed in compression so that once sprinkler head 10 is activated, annular spring 70 and plug 68 eject from outlet 27.

Figure 9:
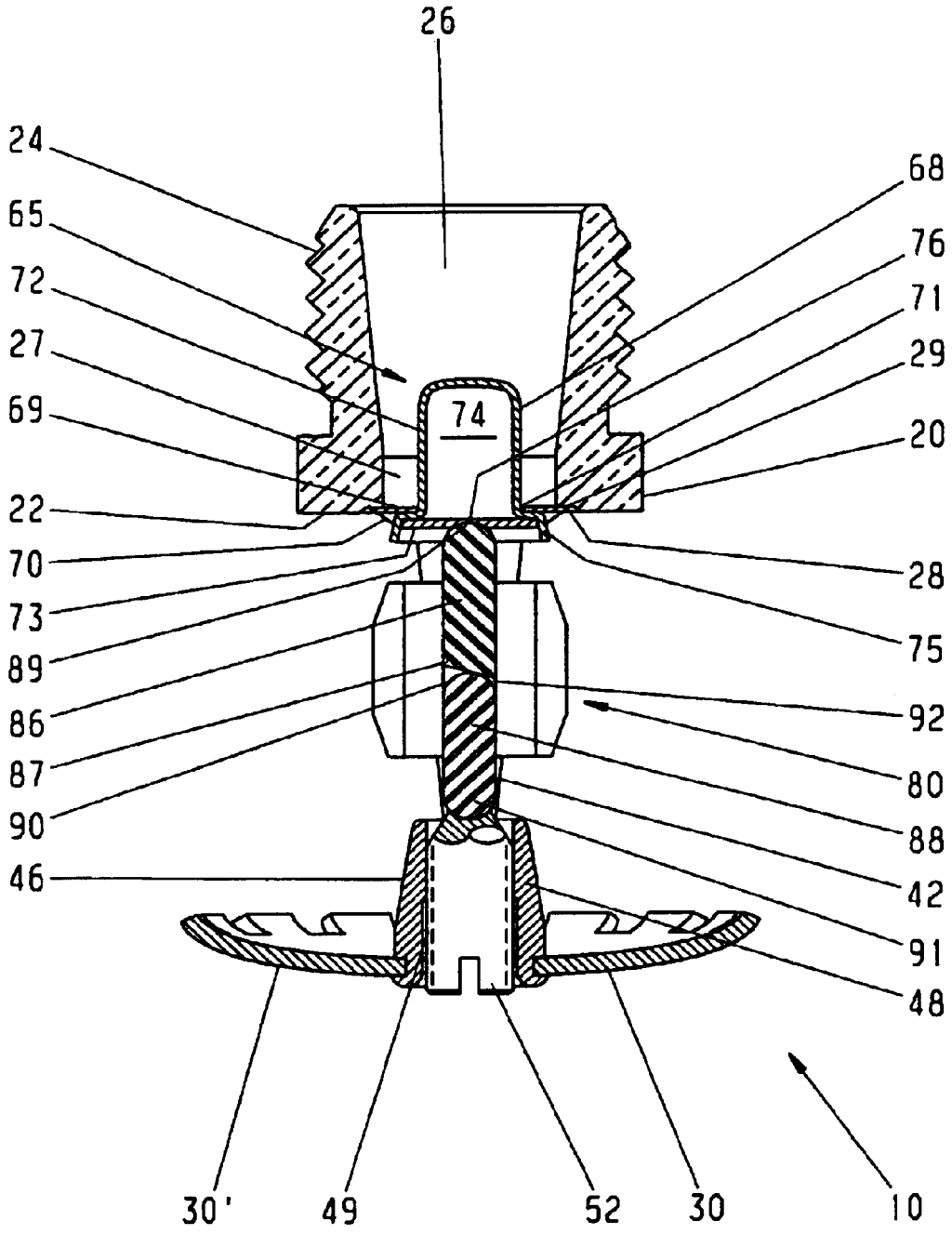
FIG. 9 is a sectional view taken along line X—X of FIG. 8.
Figure 10:
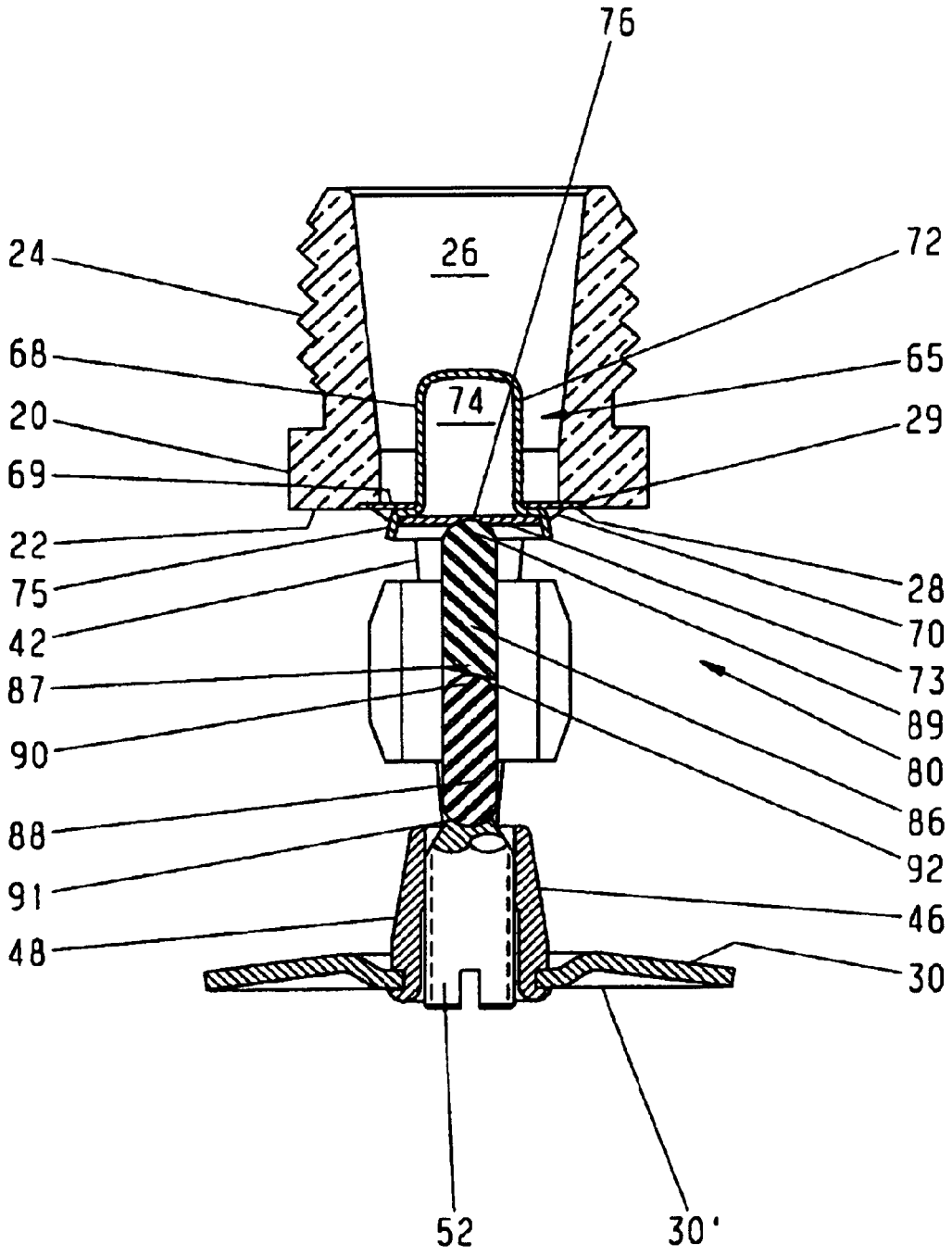
FIG. 10 is a sectional view of a sprinkler head according to an alternative preferred embodiment.
Figure 11:
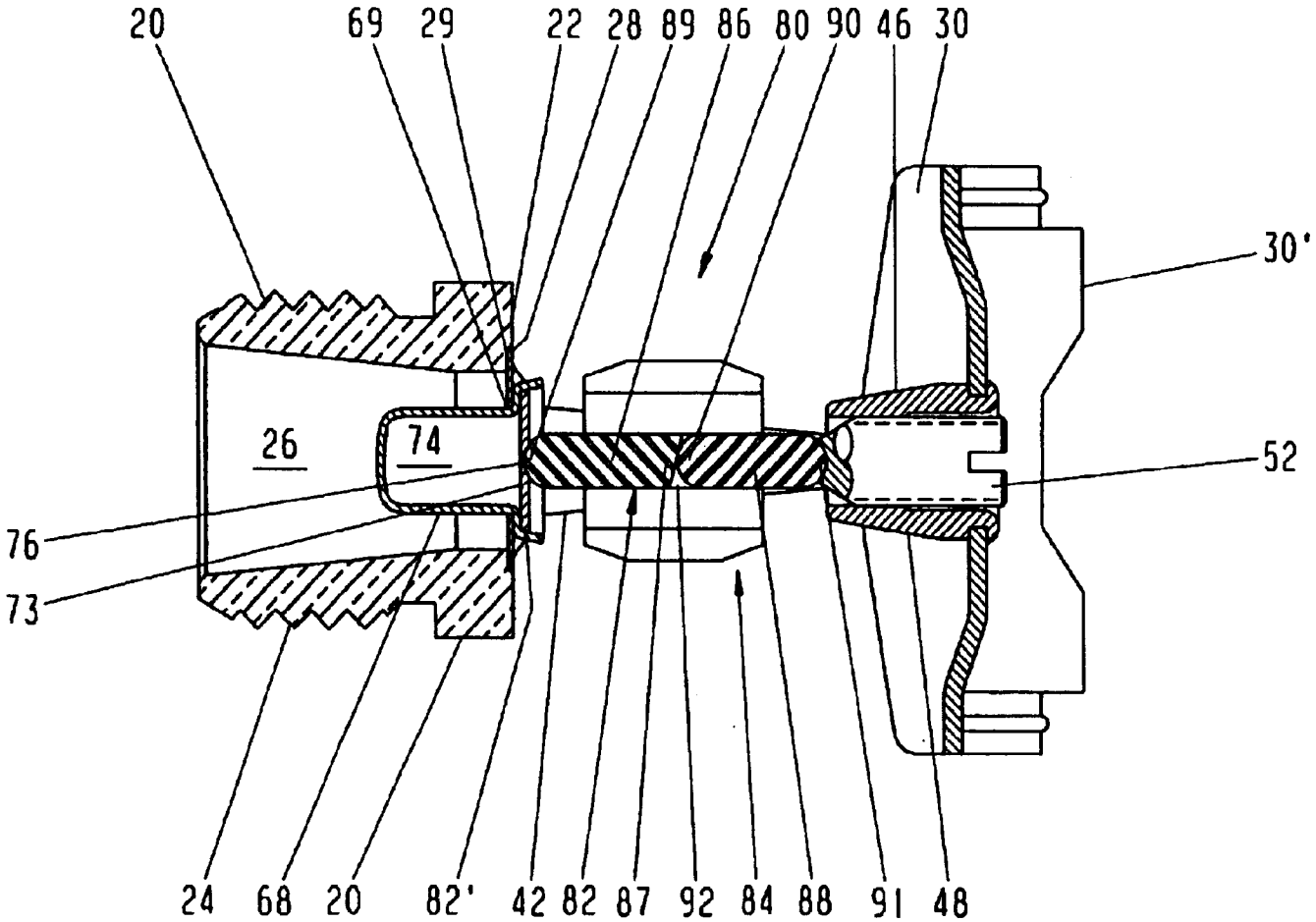
FIG. 11 is the same view as FIG. 10 of a sprinkler head according to still another alternative preferred embodiment.

FIGS. 8 and 9 depict sprinkler body 20 in an orientation such that top surface 30' of fluid deflector 30 is positioned in a horizontal plane above the horizontal plane defined by top region 22 of sprinkler body 20. Thus, as illustrated, sprinkler body 10 is characterized as an upright sprinkler head. However, it will be recognized by those with ordinary skill in the art that sprinkler head 10, may also be a pendent type sprinkler body, as illustrated in FIG. 10, and in such an orientation, the horizontal plane defined by top surface 30' of fluid deflector 30 would be positioned below the horizontal plane defined by top region 22 of sprinkler body 20. In addition, as illustrated in FIG. 11, sprinkler head 10 may also be characterized as a sidewall sprinkler, wherein sprinkler body 20 would project a substantially orthogonally from a vertical sidewall 102. Consequently, it will be understood that trigger assembly 80, as hereinafter described in detail, may be used in conjunction with a pendent, upright or sidewall sprinkler head design, without departing from the spirit and scope of the invention.

Trigger assembly 80 includes a compression actuator or element 82 and a thermally sensitive element or thermal sensor 84. In one preferred embodiment, as shown in FIGS. 8–12, compression actuator 82 includes a pair of actuators 86 and 88 which substantially comprise elongate cylindrical bodies and are axially aligned. Actuator 86 has a contact end 87 and a rounded end 89, while actuator 88 has a contact end 90 and a rounded end 91. Contact end 87 of actuator 86 is cut at a preselected angle $\alpha$ off a plane orthogonal to the center longitudinal axis 86*a* of actuator 86 or the horizontal (as viewed in FIG. 12) while contact end 90 of actuator 88 has a generally rounded surface. When in position, center axis 86*a* of actuator 86 and center axis 88*a* of actuator 88 are substantially aligned, with contact end 90 of actuator abutting contact with contact end 87 of actuator 86, while rounded end 89 of actuator 86 contacts compression screw 52 and rounded end 91 of actuator 88 is in abutting contact with detent 76 of insert 73. As will be readily understood by one with ordinary skill in the art, when actuators 86, 88 are axially aligned, compression element 82 is inherently unstable. As used herein, the phrase "inherently unstable" identifies a condition wherein the compression element 82, absent being acted upon by an external force, will not generically remain axially aligned in isolation. That is—any force exerted upon actuators 86 and 88 along their common center axes would result in the movement of actuators 86 and 88 in a direction out of axially alignment.

As shown in FIGS. 8 through 10, contact ends 90 and 87 define a non-uniform annulus 92 therebetween, with the outer dimension of annulus 92 being defined by the diameter of actuators 86, 88. In order to maintain the axial alignment of actuators 86, 88, an appropriate fusible material, such as solder, is positioned in annulus 92. The presence of the fusible material in annulus 92 stabilizes actuators 86, 88 in position and maintains the alignment of compression element 82 when an axial, compressive force is placed thereupon when in the assembled condition.

Preferably, angle $\alpha$ of contact end 87 of actuator 86 is in a range of approximately 2° and 10°. Most preferably, angle $\alpha$ is approximately 6°, while rounded end 89 has a radius of approximately 0.040 inches. Also, most preferably, the length of actuator 86 from end to end is approximately 0.410 inches, and actuator 86 has a diameter of 0.125 inches. With respect to actuator 88, most preferably, contact end 90 has a radius of approximately 0.062 inches, and rounded end 91 has a radius of approximately 0.040 inches, while actuator 88 has a length of approximately 0.420 inches. Also preferably, actuators 86 and 88 each have a diameter in a range of approximately 0.080 inches and 0.150 inches. Most preferably, actuators 86 and 88 each have a diameter of approximately 0.125 inches.

Figure 13:
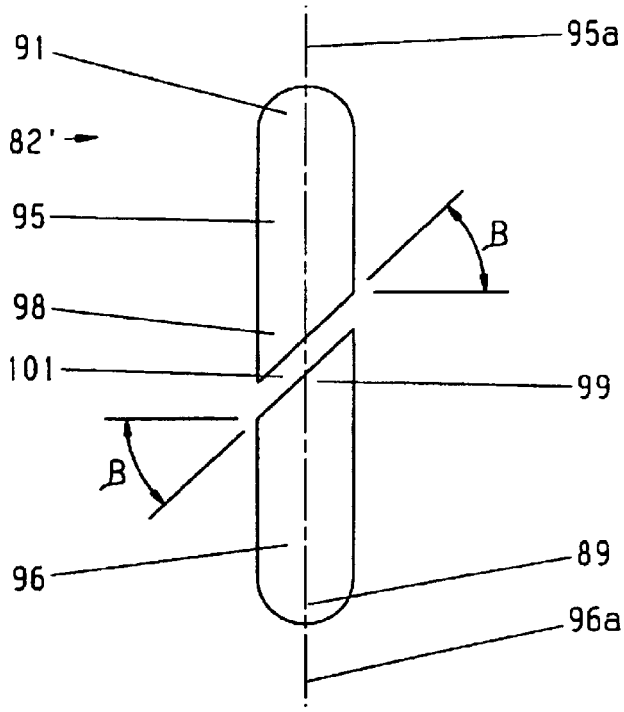
FIG. 13 is a perspective view of a compression element according to an alternative preferred embodiment.

With reference FIG. 13, in an alternative preferred embodiment, compression actuator or element 82' includes a pair of actuators 95, 96, each of which comprises an elongate substantially cylindrical body and has a contact end 98, 99, respectively cut at a preselected angle $\beta$ from axes perpendicular to the central axes 95*a* and 96*a* of actuators 95 and 96, respectively, or from the horizontal (as viewed in FIG. 13). Preferably, angle $\beta$ is in a range of approximately 5° and 15°, most preferably approximately 10°. The slanted cut of contact ends 98, 99 of compression actuator 82' yields a compression actuator which is inherently unstable absent the presence of a fusible material in the area 101 defined between contact ends 98, 99.

Figure 14:
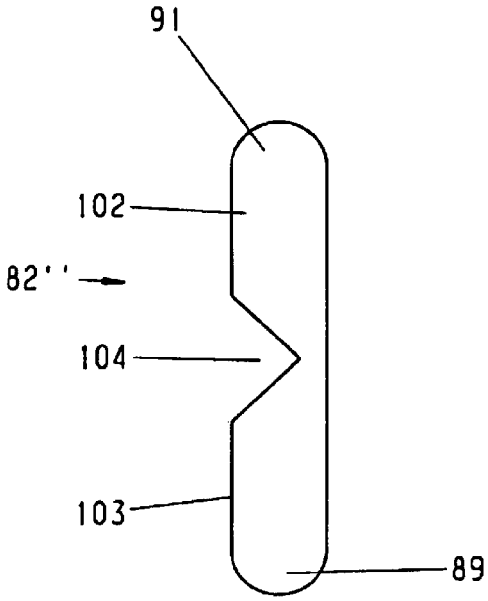
FIG. 14 is a perspective view of a compression element according to still another alternative preferred embodiment.

Turning now to FIG. 14, a compression actuator 82" includes a single actuator 102 having substantially an elongate cylindrical body with notch 104 formed therein. Notch 104 begins at the periphery 103 of actuator 102 and terminates at a distance which is preferably greater than the radius of actuator 102. Notch 104 may be of any shape and/or size, which when subjected to a preselected axial compressive force, causes the failure or breaking of actuator 102. A fusible material is positioned in notch 104 so as to maintain the structural integrity of compression actuator 82" as an axial, compressive force is exerted thereupon.

Figure 15:
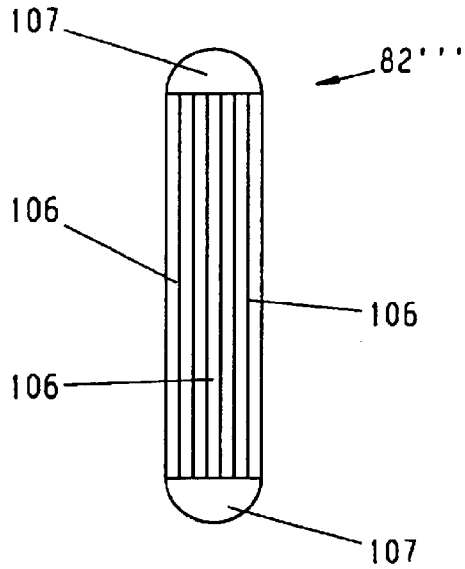
FIG. 15 is a perspective view of a compression element according to still yet another alternative preferred embodiment.

Referring now to FIG. 15, compression actuator or element 82'" is comprised of a bundle or plurality of vertically oriented rods 106 adhered or joined together by fusible material. Furthermore, rods 106 may be twisted in the axial direction to increase their strength, and include end caps 107 at their ends and joined thereto by a fusible material. Rods 106 may be of any number and material, which when exposed to the fusing temperature of a fusible material, are incapable of maintaining the axial compressive load imparted by compression member 52. That is, when the fusible material reaches its fusing temperature, the axial force exerted on rods 106 causes the plurality of rods 106 to bend or flex.

Compression actuator 82 through 82'" is preferably made of an insulative material. Most preferably, compression actuator 82 through 82''' is made of a stainless steel alloy, titanium, ceramic, quartz, nickel, or a composite thereof.

Figure 16:
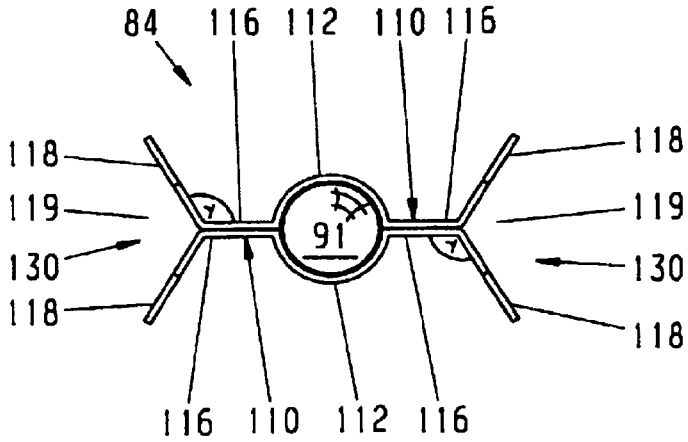
FIG. 16 is a plan view of the trigger assembly of FIGS. 8 through 11.
Figure 12:
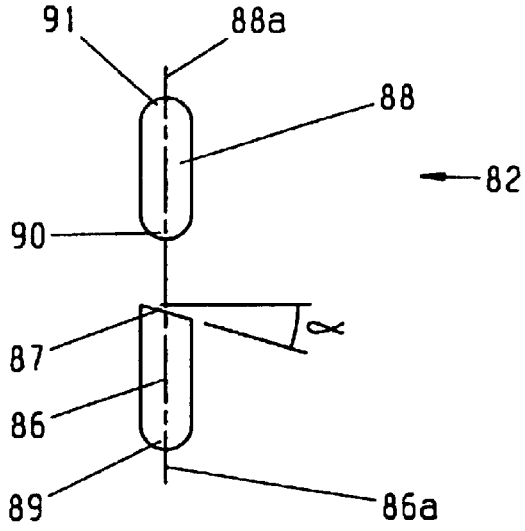
FIG. 12 is an exploded perspective view of a compression element of a trigger assembly according to the present invention.

Referring to FIG. 16, thermal sensor 84 includes at least two portions or members 110, which in the illustrated embodiment are substantially identical in construction. Each member 110 includes an attachment section 112, substantially shaped or contoured to the outer dimension or exterior surface of compression actuator 82 through 82'''. In the illustrated embodiments, attachment section 112 is semi-cylindrical to contour to the generally cylindrical shape of compression actuator 82 through 82'''; however, it will be recognized by those with ordinary skill in the art that if compression actuator 82 through 82''' is made with an exterior surface having a different shape, attachment section 112 of members 110 may be configured to assume such shape without departing from the spirit and scope of the invention. Extending from each end 114 of attachment section 112 is a generally linear connection, or second section 116. Second section 116 preferably has the same height as attachment section 112; however, it will be appreciated that second section 116 may be formed having a lesser height than attachment section 112. Projecting from second section 116 at a preselected angle $\gamma$ is a third section or fin 118. Preferably angle $\gamma$ is in a range of approximately 100° and 140°, and most preferably, is approximately 120°. Fin 118 is not co-planar with a plane defined by the center or longitudinal axis of compression actuator 82 through 82'''. That is, fin 118 also defines a plane angularly related to the longitudinal axis of compression actuator 82 through 82'''.

Figure 17:
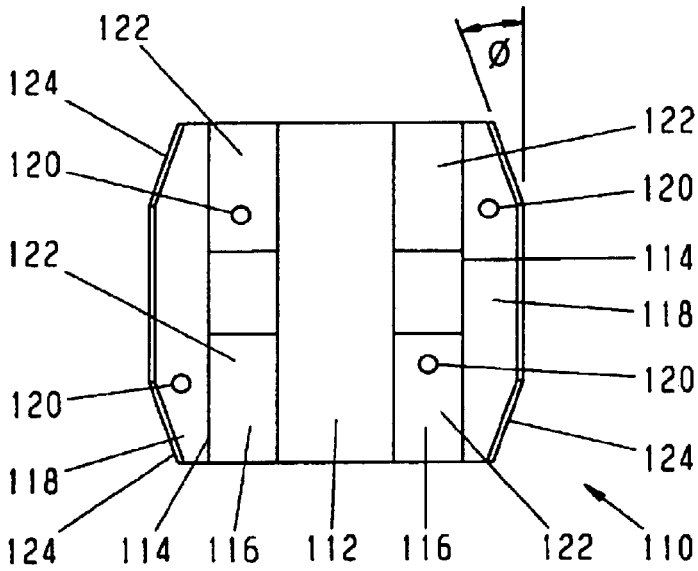
FIG. 17 is a side view of a member of a sensor element of FIGS. 8 through 16.
Figure 26:
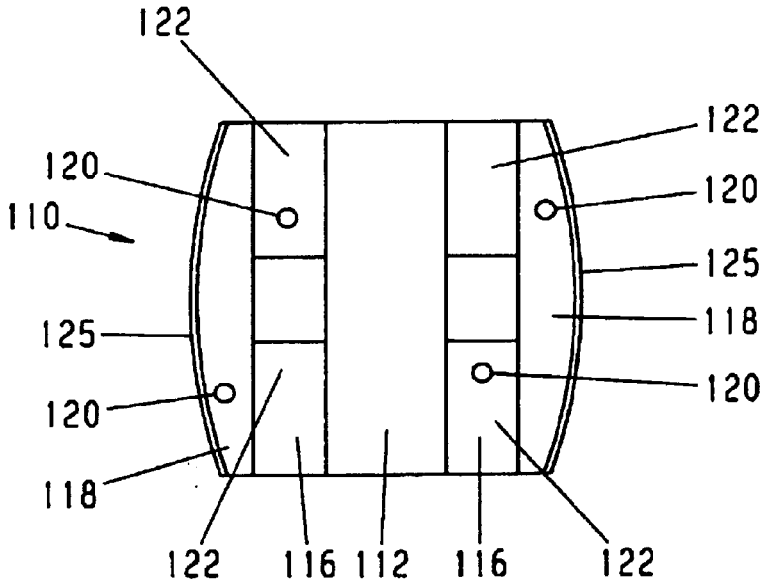
FIG. 26 is the same view as FIG. 25, according to another alternative preferred embodiment.

Second section 116 may be a solid body, or alternatively, as shown in FIG. 17, may include one or more air flow apertures 120. The purpose of apertures 120 is to permit a flow of heated air through second section 116 and thereby increase the rate of conduction of thermal sensor 84 to the requisite fusing temperature. Alternatively, second section 116 may be defined by two or more flanges 122 placed in spaced relation. Fins 118 may also be formed with one or more air flow apertures 120, as depicted in FIG. 17. Each end 124 of fin 118 is cut at an angle $\Phi$. Preferably, angle $\Phi$ is in a range of approximate 15° and 75°. Most preferably, angle $\Phi$ is approximately 45°. Alternatively, each outer edge 125 of fin 118 has an arcuate shape, as shown in FIG. 26.

When in the assembled position, compression actuator 82 through 82''' extends substantially longitudinally with respect to frame 40. Attachment section 112 of each member 110 surrounds, at least in part, the periphery of compression actuator 82 through 82'''. When two members 110 are utilized to comprise thermal sensor 84 and compression actuator 82 through 82''' has a substantially cylindrical shape, each second section 116 preferably assumes a half cylinder shape so that when in the assembled position at least a part of the periphery of compression actuator 82 through 82''' is surrounded by thermal sensor 84. The height 126 of thermal sensor 84 is preferably slightly less than the height of compression actuator 82 through 82''' such that ends of compression actuator 82 may contact compression screw 52 and sealing assembly 65, respectively.

In the assembled position, each member 110 is positioned about compression actuator 82 through 82''' such that second sections 116 are in a generally overlapping position (FIGS. 8 and 16). Further, if air flow apertures 120 are utilized, such air flow apertures 120 of each second section 116 and/or fins 118 are in substantial registry. The pair of fins 118 extending from overlapping second sections 116 of members 110 define a heat gathering element 130. Heat gathering element 130, although not wishing to be bound by theory, is thought to be at least partially responsible for the increased responsiveness of trigger assembly 80. Again, although wishing not to be bound by theory, it is believed that the area 119 that is defined between fins 118 traps and maintains heat therebetween such that efficient heat transfer to second sections 116 and attachment sections 112 is achieved. Members 110 are attached to one another and held about compression actuator 82 through 82''' by a layer of fusible material positioned between second sections 116.

When assembled and when the fusible material is positioned between the respective actuators of compression actuator 82 through 82', thermal sensor 84 along with the fusible material, which is positioned in notch 104 of compression actuator 82" or embedded between the wires 106 of compression actuator 82''', maintains compression actuator 82 through 82''' in a stable position between sealing assembly 65 and compression screw 52. The fusible material position between or in the component(s) of compression actuator 82 through 82''' also hold thermal sensor 84 in position.

Most preferably, members 110 have a height of approximately 0.5 inches, while fins 118 have a length in a range of approximately 0.10 inches and 0.200 inches. Also, most preferably, second sections 116 have a length of approximately 0.110 inches, while attachment sections 112 express a radius of approximately 0.065 inches.

Figure 25:
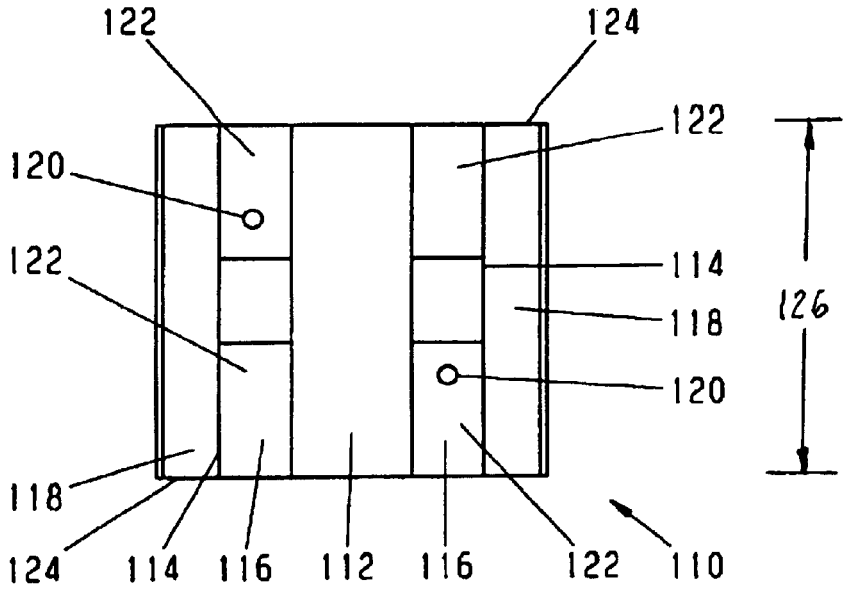
FIG. 25 is a side view of a member of a sensor element of the trigger assembly of FIG. 24.
Figure 24:
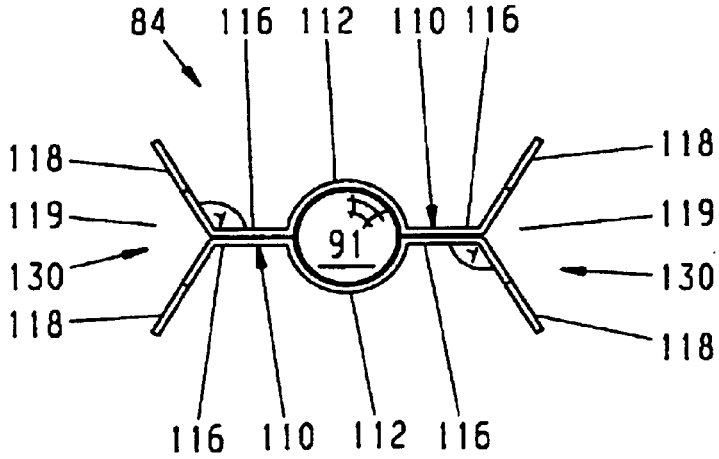
FIG. 24 is a plan view of a trigger assembly according to yet another alternative preferred embodiment.

In an alternative preferred embodiment, as shown in FIGS. 24 and 25, fins 118 of members 110 are shorter in length, having a length preferably in a range of approximately 0.040 and 0.060 inches. Also, in this embodiment, fins 118 are generally rectangularly shaped and do not have slanted or accurate ends 124.

Figure 18:
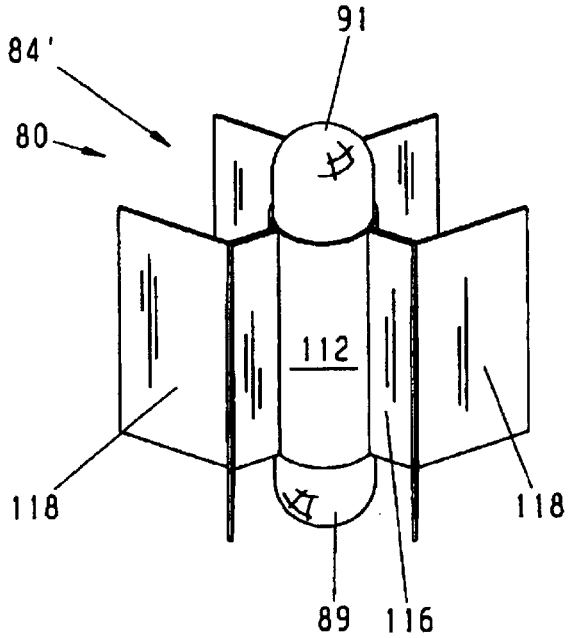
FIG. 18 is a perspective view of a trigger assembly according to an alternative preferred embodiment.
Figure 19:
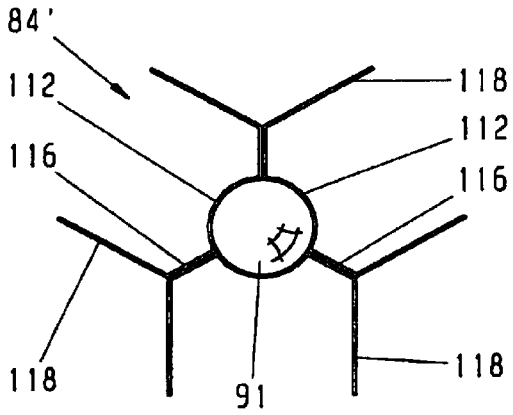
FIG. 19 is a plan view of the trigger assembly of FIG. 18.

Turning now to FIGS. 18 and 19, there is shown an alternative embodiment of thermal sensor 84'. Thermal sensor 84' utilizes three members 110. In this embodiment, attachment section 112 has an arc length of approximately one-third of the circumference of the compression actuator 82 through 82''', such that when in the assembled position, thermal sensor 84' surrounds the periphery of compression actuator 82 through 82'''. Also, when utilizing three members 110, each second section 116 extends from attachment section 112 at a preselected angle.

Figure 20:
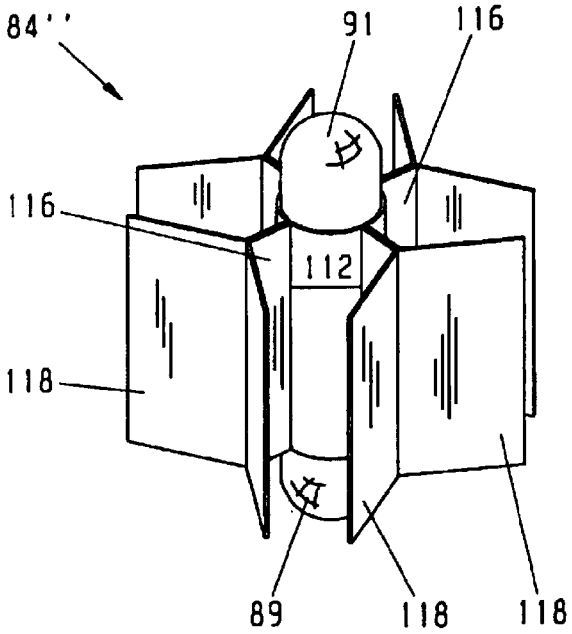
FIG. 20 is a perspective view of a trigger assembly according to still another alternative embodiment.
Figure 21:
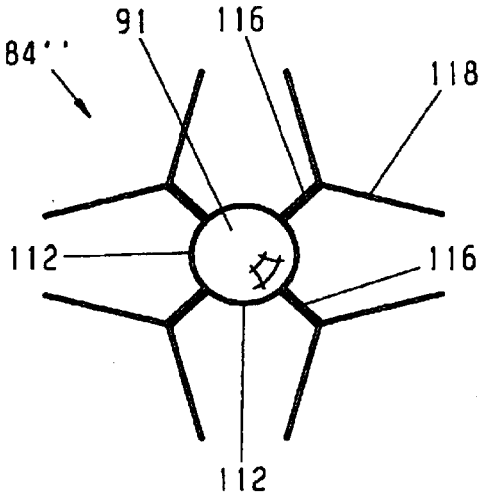
FIG. 21 is a plan view of the trigger assembly of FIG. 20.

Turning now to FIGS. 20 and 21, there is shown a thermal sensor 84", according to another alternative preferred embodiment. In this embodiment, four members 110 are utilized to define thermal sensor 84". Attachment section 112 of thermal sensor 84" has an arc length of approximately one-fourth the circumference of compression actuator 82 through 82'''. Further, each second section 116 extends from attachment section 112 at a preselected angle.

In all other respects, thermal sensor 84' and 84" are substantially similar to thermal sensor 84. Also, it will be understood by those with ordinary skill in the art that second sections 116 of thermal sensors 84' and 84" may include air flow apertures 120 or be defined by flanges 122, and also that fins 118 may include angled ends 124.

Members 110 of thermal sensor 84 through 84" are made of a conductive material such as, for example, copper alloy, beryllium copper, or beryllium nickel. Also, the external surface of thermal sensor 84 through 84" may be coated with a heat absorbing coating such as, for example, a dark colored acrylic paint.

Figure 22:
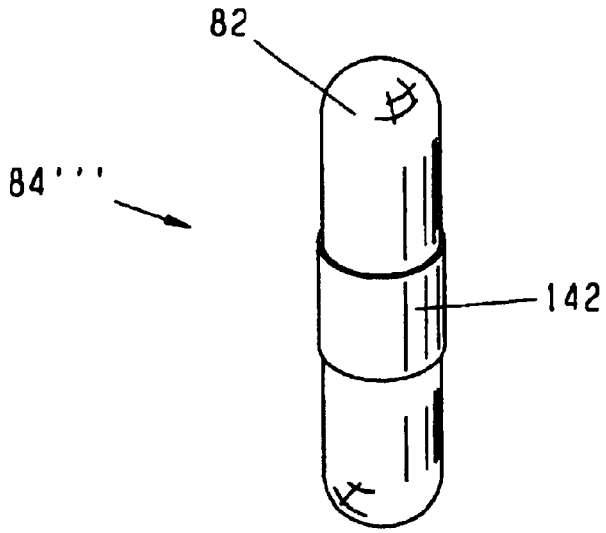
FIG. 22 is a perspective view of a trigger assembly according to yet another alternative embodiment.
Figure 23:
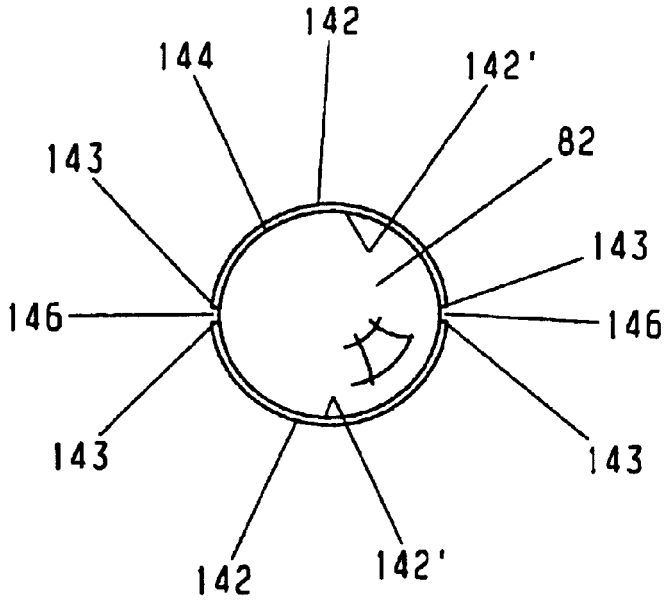
FIG. 23 is a plan view of the trigger assembly of FIG. 22.

Turning now to FIGS. 22 and 23, according to another alternative preferred embodiment, a thermal sensor 84''' includes a pair of arcuate members 142. Each arcuate member 142 has an inner surface 142' contoured to the exterior surface of compression actuator 82 through 82".

Arcuate members 142 are placed about the exterior surface of compression actuator 82', 82" such that arcuate members 142 surround the interstice formed between the actuators of compression actuator 82 or 82' or the notch formed in the actuator of compression actuator 82". When in the assembled position, arcuate members 142 are joined one to another by the placement of a fusible material within the vertical channels 146 defined by ends 143 of arcuate members 142. Arcuate members 142 may be any thermally conductive material normally encountered in the art. Preferably, arcuate members 142 are made of a copper alloy.

To assemble trigger assembly 80 (using thermal sensor 84 comprised of two members 110 as an example), compression actuator 82 through 82'" is first prepared by placing an appropriate amount of fusible material 81 therein. With respect to compression actuator 82, a fusible material is placed in annulus 92. With respect to compression element 82', the fusible material is positioned between contact ends 98 and 99. Similarly, with respect to compression actuator 82" an appropriate amount of fusible material is positioned in notch 104. When employing compression actuator 82'", the fusible material is positioned about the perimeter of wires 106 and/or imbedded therebetween. Thereafter, members 110 are placed about the perimeter of compression actuator 82 through 82'", with a layer of fusible material positioned between overlapping second sections 116. When employing the annular bands 142 of thermal sensor 84'" a fusible material is positioned in channels 146 to thereby secure thermal sensor 84'" about compression actuator 82 through 82".

Thereafter, sprinkler head 10 may be assembled by first installing sealing assembly 65 in outlet 27 of central orifice 26 by placing annular spring 70 in supporting contact with annular shoulder 29. Thereafter, plug 68 is placed through aperture 71 of annular spring 70 with its external surface resting on the perimeter of annular spring 70. Once sealing assembly 65 is in position, trigger assembly 80 is positioned with end 89 of compression actuator 82 through 82'" in abutting contact with detent 76 of insert 73. When so positioned, end 91 of compression actuator 82 through 82" will be positioned a preselected distance below the bottom surface of boss 48. When utilizing compression actuator 82'", end caps 107 are in contact with sealing assembly 65 and compression screw 52. Once trigger assembly 80 is in position, compression screw 52 is rotated within boss 48 and eventually contacts end 91 or end cap 107 and, as a result, exerts a compression force upon compression actuator 82 substantially along its center axis. Continued rotation of compression screw 52 forces sealing assembly 65 into sealing engagement with outlet 27 of central orifice 26. Once sealing assembly 65 is positioned in sealing contact with outlet 27, deflector 30 is positioned on boss 48 and secured thereto according to any procedure normally utilized in the art.

In operation, under non-activated conditions, thermal sensor 84 through 84'" maintains compression actuator 82 through 82'" in a stable position and assures that a sealing engagement is maintained between sealing assembly 65 and outlet 27 of central orifice 26. In response to a fire, the temperature surrounding trigger assembly 80 will increase, while the heat gathering elements 130, defined by fins 118, increase the retention of heat by members 110 to thereby raise the fusible material to its fusing temperature. When the fusible material reaches its fusing temperature, members 110 of thermal sensor 84 will separate. In addition, fusible material contained within compression actuator 82 through 82'" will liquefy. The release of thermal sensor 84 from the periphery of compression element 82, in combination with the liquefication of the fusible material positioned within compression actuator 82 through 82'", causes compression actuator 82 through 82'" to return to its inherently unstable state. This inherent instability coupled with the compressive force along the central axis of compression actuator 82 through 82'" results in the separation, fracture, or bending of the compression actuator 82 through 82'". Once the compression actuator 82 through 82'" loses its structural integrity, it will collapse and fall away from sprinkler body 20. When compression actuator 82 through 82'" falls away from sprinkler body 20, the compressive force upon sealing assembly 65 is released and the pressure of the water or other fire extinguishing fluid residing within central orifice 26 causes the expulsion of sealing assembly 65 from outlet 27. Water or other fire extinguishing fluid will be expelled from central orifice 26 and subsequently deflected in an optimum pattern by deflector 30 in order to suppress or control a fire.

The trigger assembly of the present invention, due to its configuration, exhibits an increased response time, which in turn enables the sprinkler head to which it is attached to be classified as a quick response sprinkler head and to satisfy the criteria for a quick response sprinkler under FMRC, UL, and NFPA.

It is to be understood that the foregoing is a description of the preferred embodiments only. One skilled in the art will recognize that variations, modifications and improvements may be made without departing from the spirit and scope of the invention disclosed herein. The scope of protection is to be measured by the claims which follow in the breath of interpretation which the law allows, including the doctrine of equivalents.

The embodiments in which an exclusive property or privilege is claimed are defined as follows:

1. A trigger assembly for an automatic sprinkler head having a sprinkler body having a central orifice defining an outlet for dispensing a fluid, a frame extending from the sprinkler body in a direction beyond said outlet, and a sealing assembly for releasably sealing the central orifice, said trigger assembly selectively maintaining the sealing assembly in a sealed condition, said trigger assembly comprising:

a compression element positioned between the frame and the sealing assembly; and a thermally sensitive element surrounding at least in part said compression element and joined at least in part to said compression element by a fusible material, said thermally sensitive element comprising at least two portions, wherein each portion comprises:

an attachment section shaped to substantially correspond to at least a section of said compression element, at least one connection section projecting from said attachment section in a direction away from said compression element, said at least one connection section having a distal end spaced from said attachment section, and at least one fin projecting from said distal end of said connection section, said at least one fin having a portion thereof defining a plane forming an angular relationship to at least a portion of said at least one connection section, whereby said thermally sensitive element enhances the magnitude of compression of said compression element when joined thereto and releases said sealing assembly when said thermally sensitive element is removed from said compression element.

2. A trigger assembly for an automatic sprinkler head having a sprinkler body having a central orifice defining an outlet for dispensing a fluid, a frame extending from the sprinkler body in a direction beyond said outlet, and a sealing assembly for releasably sealing the central orifice, said trigger assembly selectively maintaining the sealing assembly in a sealed condition, said trigger assembly comprising:

a compression element adapted to be positioned between the frame and the sealing assembly, wherein said compression element comprises a first actuator having a rounded contact end and a second actuator having an angled contact end, wherein said rounded contact end and said angled contact end are positioned in proximity to each other; and a thermally sensitive element surrounding at least in part said compression element and joined at least in part to said compression element by a fusible material, said thermally sensitive element comprising at least two portions, wherein each portion comprises:

an attachment section shaped to substantially correspond to at least a section of said compression element, at least one connection section projecting from said attachment section in a direction away from said compression element, said at least one connection section having a distal end spaced from said attachment section, and at least one fin projecting from said distal end of said connection section, said at least one fin having a portion thereof defining a plane forming an annular relationship to at least a portion of said at least one connection section, whereby said thermally sensitive element enhances the magnitude of compression of said compression element when joined thereto and releases said sealing assembly when said thermally sensitive element is removed from said compression element.

3. The trigger assembly as recited in claim 2, wherein said rounded contact end and said angled contact end define a non-uniform annulus therebetween, and wherein said fusible material is positioned in said non-uniform annulus.

4. The trigger assembly as recited in claim 1, wherein said compression element comprises an actuator formed with a notch.

5. The trigger assembly as recited in claim 4, wherein said fusible material is positioned in said notch.

6. The trigger assembly as recited in claim 1, wherein said compression element comprises a pair of actuators, each actuator of said pair of actuators having an angled contact end.

7. The trigger assembly as recited in claim 1, wherein said compression element comprises a substantially cylindrical body, and said attachment section of each portion of said at least two portions having a semi-cylindrical shape.

8. The trigger assembly as recited in claim 1, wherein said at least two portions comprise three portions.

9. The trigger assembly as recited in claim 1, wherein said at least two portions comprise four portions.

10. The trigger assembly as recited in claim 1, wherein said at least one connection section comprises a pair of connection sections projecting in opposite directions.

11. The trigger assembly as recited in claim 1, wherein said at least one connection section defines a plane, and wherein said at least one fin projects from said end of said connection section at a preselected angle from said plane.

12. The trigger assembly as recited in claim 11, wherein said preselected angle is in a range of approximately 100° and 140°.

13. The trigger assembly as recited in claim 1, wherein said at least one connection section of one of said at least two portions is positioned in substantially overlapping relation with said at least one connection section of the other portion of said at least two portions.

14. The trigger assembly as recited in claim 2, wherein the angle of said angled contact end is in a range of approximately 2° and 10° from the horizontal.

15. The trigger assembly as recited in claim 6, wherein the angle of said angled contact end of each actuator of said pair of actuators is in a range of approximately 2° and 10° from the horizontal.

16. The trigger assembly as recited in claim 1, wherein said at least one connection section includes at least one airflow aperture.

17. The trigger assembly as recited in claim 1, wherein said compression element is made of an insulative material.

18. The trigger assembly as recited in claim 1, wherein each portion of said at least two portions comprises a thermally conductive material.

19. The trigger assembly as recited in claim 1, wherein said compression element comprises a plurality of rods.

20. The trigger assembly as recited in claim 19, wherein each rod of said plurality of rods comprises an insulative material.

21. The trigger assembly as recited in claim 20, wherein said thermally sensitive element further comprises a heat absorbent material coating.

22. A trigger assembly for an automatic sprinkler head having a sprinkler body having a central orifice forming an outlet for dispensing a fluid, a frame extending beyond said outlet, an adjustable compression member mounted on said frame to adjustably exert compression on said trigger assembly, and a sealing assembly for releasably sealing the central orifice, said trigger assembly comprising:

a compression element adapted to be positioned between the sealing assembly and the compression member, said compression element extending longitudinally with respect to the sprinkler frame and having a center axis, wherein said compression element is inherently unstable when subjected to a compressive force along said center axis by adjustment of the compression member; and a thermally sensitive element comprising an attachment section surrounding at least a portion of said compression element and joined at least in part to said compression element by a fusible material, said fusible material having a pre-selected fusing temperature, said thermally sensitive element configured to maintain said compression element in a stable position between the compression member and the sealing assembly when said fusible material is below said fusing temperature and to release said compression element to an unstable condition when said fusible material is above said fusing temperature, said thermally sensitive element further comprising at least one heat gathering member spaced from said attachment section, said at least one heat gathering member defining at least one plane, wherein said at least one plane is not co-planar with a plane defined by said center axis of said compression element.

23. The trigger assembly as recited in claim 22, wherein said thermally sensitive element further comprises at least two members, each member of said at least two members comprising:

a first section shaped to surround at least a portion of said compression element;

at least one second section projecting from said first section, wherein said at least one second section is substantially co-planar with a plane defined by said center axis of said compression element, said at least one second section having an end; and at least one third section projecting from said end of said at least one second section at a preselected angle, wherein one third section of one member and a third section of the other member of said at least two members define said heat gathering member.

24. The trigger assembly as recited in claim 23, wherein said at least one second section comprises two second sections extending in opposite directions from said first section, and said at least one third section comprises two third sections, each third section of said two third sections extending from said end of a second section of said two second sections.

25. The trigger assembly as recited in claim 24, wherein each second section of one member is positioned in substantially overlapping relation with each second section of the other member of said at least two members.

26. The trigger assembly as recited in claim 23, wherein said at least one second section includes at least one airflow aperture.

27. The trigger assembly as recited in claim 23, wherein said at least one second section comprises at least two flanges positioned in spaced relation.

28. A trigger assembly for an automatic sprinkler head having a sprinkler body having a central orifice forming an outlet for dispensing a fluid, a frame extending beyond said outlet, an adjustable compression member mounted on said frame to adjustably exert compression on said trigger assembly, and a sealing assembly for releasably sealing the central orifice, said trigger assembly comprising;

a compression element adapted to be positioned between the sealing assembly and the compression member, said compression element adapted to extend longitudinally with respect to the sprinkler frames and having a center axis, wherein said compression element is inherently unstable when subjected to a compressive force along said center axis, said compression element comprising a first actuator having a rounded contact end and a second actuator having an angled contact end, wherein said rounded contact end and said angled contact end are positioned in proximity; and a thermally sensitive element comprising an attachment section surrounding at least a portion of said compression element and joined at least in part to said compression element a by fusible material, said fusible material having a pre-selected fusing temperature, said thermally sensitive element configured to maintain said compression element in a stable position between the compression member and the sealing assembly when said fusible material is below said fusing temperature and to release said compression element to an unstable condition when said fusible material is above said fusing temperature, said thermally sensitive element further comprising at least one heat gathering member spaced from said attachment section, said at least one heat eathering member defining at least one plane, wherein said at least one plane is not co-planar with a plane defined by said center axis of said compression clement.

29. The trigger assembly as recited in claim 28, wherein said rounded contact end and said angled contact end define a non-uniform annulus therebetween, and wherein said fusible material is positioned in said non-uniform annulus.

30. The trigger assembly as recited in claim 22, wherein said compression element comprises an actuator formed with a notch.

31. The trigger assembly as recited in claim 23, wherein said compression element comprises a pair of actuators, each actuator of said pair of actuators having an angled contact end.

32. The trigger assembly as recited in claim 23, wherein said compression element comprises a plurality of rods.

33. The trigger assembly as recited in claim 23, wherein said thermally sensitive element further comprises a heat absorbent material coating.

34. The trigger assembly as recited in claim 23, wherein said preselected angle is in a range of 100° and 140°.

35. A quick response sprinkler head comprising:

a sprinkler body having a central orifice defining a fluid outlet;

a sealing assembly for releasably sealing said outlet to prevent the flow of fluid through said outlet;

a frame extending from said sprinkler body beyond said outlet;

a boss carried by said frame and having an aperture;

a compression member movably positioned in said aperture;

a direct load trigger assembly for releasably retaining said sealing assembly in said outlet, said direct load trigger assembly comprising:

a compression element extending longitudinally with respect to the sprinkler head and having a first end abutting said compression member and having a second end abutting said sealing assembly; and a thermally sensitive element attached at least in part to the exterior of said compression element by a fusible material, wherein said fusible material has a fusing temperature, said thermally sensitive element maintaining said compression element in compression between said compression member and said sealing assembly when said fusible material is below said fusing temperature, said thermally sensitive element comprising an attachment section surrounding at least a section of said compression element and at least one heat gathering member spaced from said attachment section, and said at least one heat gathering element extending in a direction away from said compression element and having at least a portion thereof forming a plane angularly related to the longitudinal axis of said compression element.

36. The quick response sprinkler head as recited in claim 35, wherein said thermally sensitive element further comprises a pair of linear sections projecting from said attachment section in substantially opposite directions, each linear section of said pair of linear sections having an end and at least one fin projecting from said end, said at least one fin projecting from said end of each linear section defining a heat gathering element.

37. A quick response sprinkler head comprising:

a sprinkler body having a central orifice defining a fluid outlet;

a sealing assembly far releasably sealing said outlet to prevent the flow of fluid through said outlet;

a frame extending from said sprinkler body beyond said outlet;

a boss carried by said frame and having an aperture;

a compression member movably positioned in said aperture;

a direct load trigger assembly for releasably retaining said sealing assembly in said outlet, said direct load trigger assembly comprising:

a compression element extending longitudinally with respect to the sprinkler head and having a first end abutting said compression member and having a second end abutting said sealing assembly, said compression element comprising a first actuator having a rounded contact end and a second actuator having an angled contact end, wherein said rounded contact end and said angled contact end are positioned in proximity; and a thermally sensitive element attached at least in part to the exterior of said compression element by a material, wherein said fusible material has a fusing temperature, said thermally sensitive element maintaining said compression element in compression between said compression member and said sealing assembly when said fusible material is below said fusing temperature, said thermally sensitive element comprising an attachment section surrounding at least a section of said compression element and at least one heat gathering member spaced from said attachment sectioning, and said at least one heat gathering element extending in a direction away from said compression element and having at least a portion thereof forming a plane angularly related to the longitudinal axis of said compression element.

38. The quick response sprinkler head as recited in claim 37, wherein said rounded contact end and said angled contact end define a non-uniform annulus therebetween, and wherein said fusible material is positioned in said non-uniform annulus.

39. The quick response sprinkler head as recited in claim 35, wherein said compression element comprises a substantially cylindrical body having a notch.

40. The quick response sprinkler head as recited in claim 39, wherein said fusible material is positioned in said notch.

41. The quick response sprinkler head as recited in claim 35, wherein said compression element comprises a pair of actuators, each actuator of said pair of actuators having an angled contact end.

42. A quick response sprinkler head comprising:

a sprinkler body having a central orifice forming an outlet;

a sealing assembly for releasably sealing said outlet;

a frame extending from said sprinkler body beyond said outlet;

a compression member movable mounted on said frame; and an externally activated direct load trigger assembly disposed between said compression member and said sealing assembly for releasably retaining said sealing assembly in said outlet, said externally activated direct load trigger assembly having a response time index (RTI) of less than or equal to approximately 50 $(\text{meter}\cdot\text{seconds})^{1/2}$.

43. The sprinkler head as recited in claim 42, wherein said externally activated direct load trigger assembly comprises:

a compression element having a first end, a second end, and a periphery, said first end abutting said compression member, said second end abutting said sealing assembly, said compression element having a center axis, said compression element being placed in compression when said compression member is moved toward said outlet, and said compression element having an exterior; and a thermally sensitive element comprising at least two substantially identical members, each member of said at least two substantially identical members attached to said periphery of said compression element by a fusible material, said fusible material having a fusing temperature, and said at least two members maintaining said compression element in compression when said fusible material is below said fusing temperature.

44. The quick response sprinkler head as recited in claim 43, wherein each member of said at least two substantially identical members comprises:

an attachment section shaped to substantially contour at least a section of said periphery of said compression element;

a connection section projecting from said attachment section in a direction away from said compression element, said connection section having an end; and at least one fin projecting from said end of said connection section.

45. The quick response sprinkler head as recited in claim 44, wherein said at least one fin projects from said connection section in a direction away from said compression element.

46. A quick response sprinkler head comprising:

a sprinkler body having a central orifice forming an outlet;

a sealing assembly for releasably sealing said outlet;

a frame extending from said sprinkler body beyond said outlet;

a compression member movable mounted on said frame; and an externally activated direct load trigger assembly disposed between said compression member and said sealing assembly for releasably retaining said sealing assembly in said outlet, said externally activated direct load trigger assembly having a response time index (RTI) of less than or equal to approximately 50 $(\text{meter}\cdot\text{seconds})^{1/2}$, said externally activated direct load trigger assembly comprises:

a compression element having a first end, a second end, and a periphery, said first end abutting said compression member, said second end abutting said sealing assembly, said compression element having a center axis, said compression element being placed in compression when said compression member is moved toward said outlet, and said compression element having an exterior, said compression element comprising a first actuator having a rounded contact end and a second actuator having an angled contact end, wherein said rounded contact end and said angled contact end are positioned in proximity; and a thermally sensitive element comprising at least two substantially identical members, each member of said at least two substantially identical members attached to said periphery of said compression element by a fusible material, said fusible material having a fusing temperature, and said at least two members maintaining said compression element in compression when said fusible material is below said fusing temperature.

47. The quick response sprinkler head as recited in claim 46, wherein said rounded contact end and said angled contact end define an annulus therebetween, and wherein said fusible material is positioned in said annulus.

48. The quick response sprinkler head as recited in claim 43, wherein said compression element comprises a substantially cylindrical body having a notch, and said fusible material being positioned in said notch.

49. The quick response sprinkler head as recited in claim 44, wherein said connection section includes at least one airflow aperture.

50. The quick response sprinkler head as recited in claim 43, wherein said compression element comprises a plurality of rods.

51. The quick response sprinkler head as recited in claim 44, wherein said at least one connection section is substantially co-planar with a plane defined by said center axis of said compression element.

52. The quick response sprinkler head as recited in claim 51, wherein said thermally sensitive element further comprises a heat absorbent material coating.

53. A quick response sprinkler head comprising:

a sprinkler body having a central orifice forming an outlet;

a sealing assembly for releasably sealing said outlet;

a frame extending from said sprinkler body beyond said outlet;

a boss carried by said frame, said boss having an aperture;

a compression member movably positioned in said aperture; and an externally activated direct load trigger assembly disposed between said compression member and said sealing assembly for releasably retaining said sealing assembly at said outlet, wherein said quick response sprinkler head complies with section 19.2.1 and section 19.5.1 of UL 199, Tenth Edition, 1999.

54. The quick response sprinkler head as recited in claim 53, wherein said externally activated direct load trigger assembly comprises:

a compression element having a first end, a second end, and a periphery, said first end abutting said compression member, said second end abutting said sealing assembly, said compression element having a center axis whereby said compression element is placed in compression when said compression member is moved toward said outlet, said compression element having an exterior; and a thermally sensitive element comprising at least two substantially identical members, each member of said at least two members being attached to at least a section of said periphery by a fusible material, substantially identical said fusible material having a fusing temperature, and said at least two members maintaining said compression element in compression when said fusible material is below said fusing temperature.

55. A quick response sprinkler head comprising:

a sprinkler body having a central orifice forming an outlet;

a sealing assembly for releasably sealing said outlet;

a frame extending from said sprinkler body beyond said outlet;

a boss carried by said frame, said boss having an aperture;

a compression member movably positioned in said aperture; and an externally activated direct load trigger assembly disposed between said compression member and said sealing assembly for releasably retaining said sealing assembly at said outlet, wherein said quick response sprinkler head has an RTI as defined by *Approval Standard*, Factory Mutual Research Corporation, May 1998, equal to or less than 90 $(\text{ft s})^{1/2}$ and a C-factor defined by *Approval Standard Automatic Sprinklers for Fire Protection*, Factory Mutual Research Corporation, May 1998, equal to or less than 1.8 $(\text{ft s})^{1/2}$, and complies with the criteria outlined in Section 4.30 of *Approval Standard, Automatic Sprinklers for Fire Protection*, Factory Mutual Research Corporation, May 1998.

56. The quick response sprinkler head as recited in claim 55, wherein said externally activated direct load trigger assembly comprises:

a compression element having a first end, a second end, and a periphery, said first end abutting said compression member, said second end abutting said sealing assembly, said compression element having a center axis, said compression element being placed in compression when said compression member is moved toward said outlet, said compression element having an exterior, and a thermally sensitive element comprising at least two substantially identical members, each member of said at least two substantially identical members being attached to at least a section of said compression element by a fusible material, said fusible material having a fusing temperature, and said at least two members maintaining said compression element in compression when said fusible material is below said fusing temperature.

* * * * *

UNITED STATES PATENT AND TRADEMARK OFFICE

CERTIFICATE OF CORRECTION

PATENT NO. : 6,918,545 B2
APPLICATION NO. : 10/143379
DATED : July 19, 2005
INVENTOR(S) : Scott Thomas Franson and Kenneth Gordon Vos It is certified that error appears in the above-identified patent and that said Letters Patent is hereby corrected as shown below:

(75) Inventors:
Line 2, "Kenneth Gordor Vos" should be --Kenneth Gordon Vos--.

Column 8:
Line 36, Delete "a" after "on".

Column 11:
Line 13, "approximatey" should be --approximately--.

Column 18:
Line 44, Claim 1, Insert --adapted to be-- after "element".

Column 19:
Line 31, "annular" should be --angular--.

Column 21:
Line 34, ";" should be --:--.
Line 38, "frames" should be --frame--.
Line 49, Delete "a" after "element".
Line 49, Insert --a-- after "by".
Line 60, "eathering" should be --gathering--.
Line 63, "clement" should be --element--.

Column 22:
Line 59, "far" should be --for--.

Column 23:
Line 15, Insert --fusible-- before "material" in the first occurrence.
Line 24, "sectioning" should be --section--.

Column 24:
Line 23, "element" should be --elements--.

UNITED STATES PATENT AND TRADEMARK OFFICE

CERTIFICATE OF CORRECTION

PATENT NO. : 6,918,545 B2
APPLICATION NO. : 10/143379
DATED : July 19, 2005
INVENTOR(S) : Scott Thomas Franson and Kenneth Gordon Vos It is certified that error appears in the above-identified patent and that said Letters Patent is hereby corrected as shown below:

Column 26:

Line 15, Insert --[50(MS) ½]-- after ""90(ft s) ½".

Line 18, Insert --[1.0(ms) ½]-- after "½".

Signed and Sealed this

Twenty-fourth Day of June, 2008

JON W. DUDAS
*Director of the United States Patent and Trademark Office*